US005983446A

United States Patent [19]

Hsia

[11] Patent Number: 5,983,446

[45] Date of Patent: Nov. 16, 1999

[54] MULTIPLE SUCTION NOZZLE VACUUM HEADS

[76] Inventor: Chih-Yu Hsia, 301 Warren Way, Arcadia, Calif. 91007

[21] Appl. No.: 09/008,445

[22] Filed: Jan. 16, 1998

[51] Int. Cl.[6] ..... A47L 9/02

[52] U.S. Cl. ..... 15/354; 15/359; 15/414

[58] Field of Search ..... 15/354, 359, 381, 15/414

[56] References Cited

U.S. PATENT DOCUMENTS

| | | | |
|---|---|---|---|
| 4,263,693 | 4/1981 | Mekelburg | 15/354 |
| 5,046,218 | 9/1991 | Cerri | 15/416 |
| 5,276,940 | 1/1994 | Renaudin | 15/354 |
| 5,347,678 | 9/1994 | Williams et al. | 15/354 |
| 5,467,501 | 11/1995 | Sepke | 15/324 |

*Primary Examiner*—Robert J. Warden, Sr.
*Assistant Examiner*—Andrew Aldag

[57] ABSTRACT

In apparatus to facilitate vacuum cleaning carpets with obstacles, the first combination comprising a suction base, at least two of each of the following components: suction heads, suction hoses, suction head position rods, dusting brush holders, dusting brush rocking devices, pairs of spring supports, and springs, the second combination comprising a suction base, at least two of each of the following components: suction heads, suction ducts, suction head position rods, dusting brush holders, dusting brush rocking devices, pairs of spring supports, and springs; the third combination comprising a suction base, at least two of each of the following components: suction heads, suction ducts, dusting brush rocking rods, dusting brush holders, dusting brush rocking devices, pairs of spring supports, and springs; the fourth combination comprising a suction base, at least two of each of the following components: suction heads, suction ducts, suction head position keepers, dusting brush rocking rods, dusting brush holders, dusting brush rocking devices, pairs of spring supports, and springs; the fifth combination comprising a suction base, at least two of each of the following components: suction heads, suction ducts, and springs.

22 Claims, 26 Drawing Sheets

MULTIPLE SUCTION NOZZLE VACUUM HEADS

BACKGROUND OF THE INVENTION

Field of the Invention

This invention relates to vacuum cleaners and particularly to vacuum heads that have multiple reactive retractable suction nozzles which allow a user to easily vacuum areas with obstruction.

SUMMARY OF THE INVENTION

Vacuum cleaning a carpeted floor with furniture could be done easily with an invented multiple suction nozzle vacuum head. Five variations of the invented devices are introduced. Basically, the first variation comprises a suction base, at least two of each of the following components: suction heads, suction hoses, suction head position rods, dusting brush holders, dusting brush rocking devices, pairs of spring supports, and springs. The second variation comprises a suction base, at least two of each of the following components: suction heads, suction ducts, suction head position rods, dusting brush holders, dusting brush rocking devices, pairs of spring supports, and springs. The third variation comprises a suction base, at least two of each of the following components: suction heads, suction ducts, dusting brush rocking rods, dusting brush holders, dusting brush rocking devices, pairs of spring supports, and springs. The fourth variation comprises a suction base, at least two of each of the following components: suction heads, suction ducts, suction head position keepers, dusting brush rocking rods, dusting brush holders, dusting brush rocking devices, pairs of spring supports, and springs. The fifth variation comprises a suction base, at least two of each of the following components: suction heads, suction ducts, and springs.

As will be seen, each of the suction nozzles of the invented devices can move back and forth along the axis of said vacuum heads so that cleaning of carpets on which are obstacles such as legs of chairs can be done easily.

These and other objects and advantages of the invention, as well as the details of illustrative embodiments, will be more fully understood from the following specification and drawings, in which:

DRAWING DESCRIPTION

FIG. 5 shows that the cams shown in FIG. 4 have rotated 180 degrees;

FIG. 7 shows that the dusting brush has swept backwards after what is shown in FIG. 6;

GENERAL DESCRIPTION

Five variations of the invented device are introduced herein in this specification.

Figure 1:
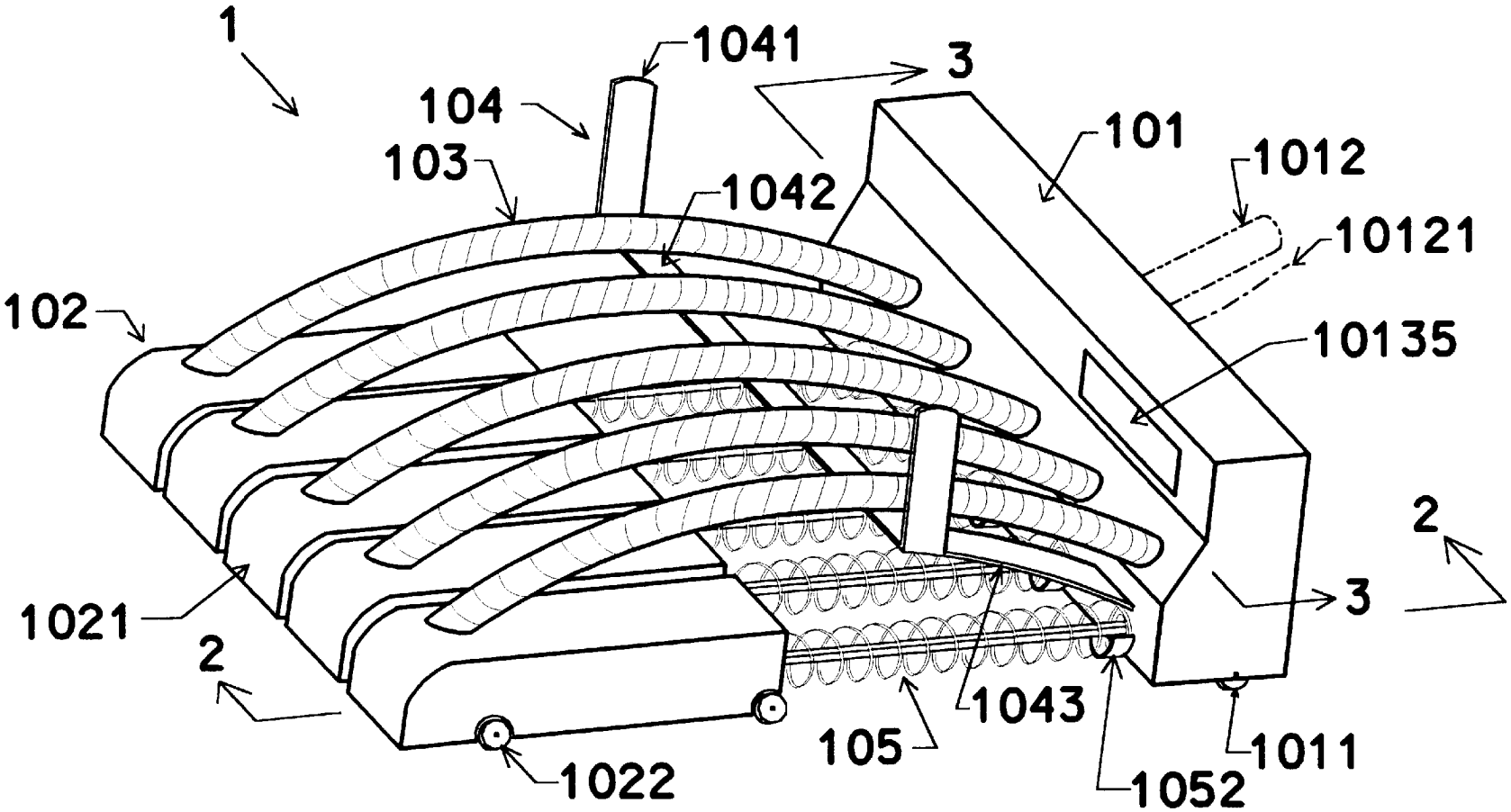
FIG. 1 is an isometric view of the first variation of the invented device.
Figure 2:
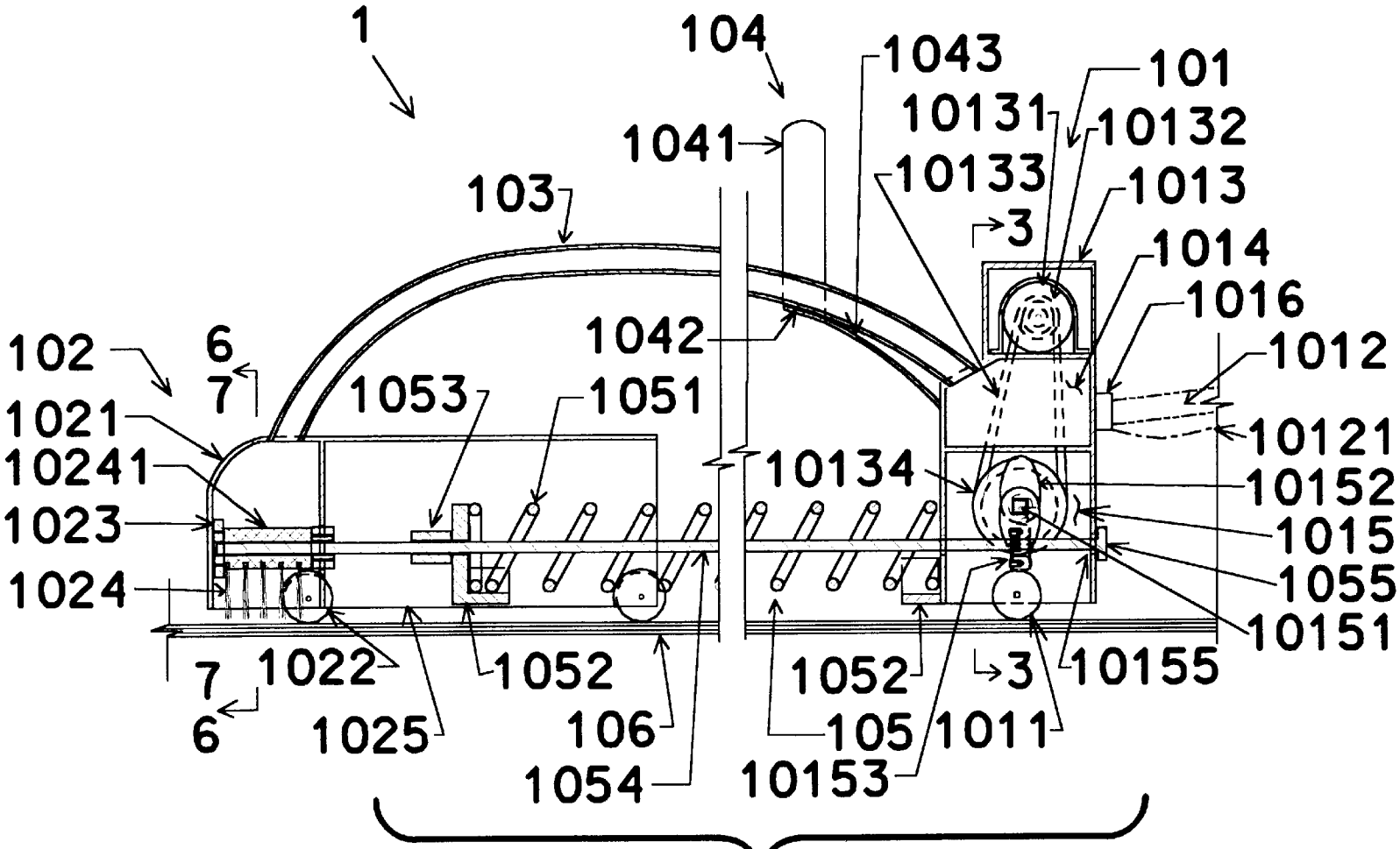
FIG. 2 is a sectional view of the device shown in FIG. 1.
Figure 3:
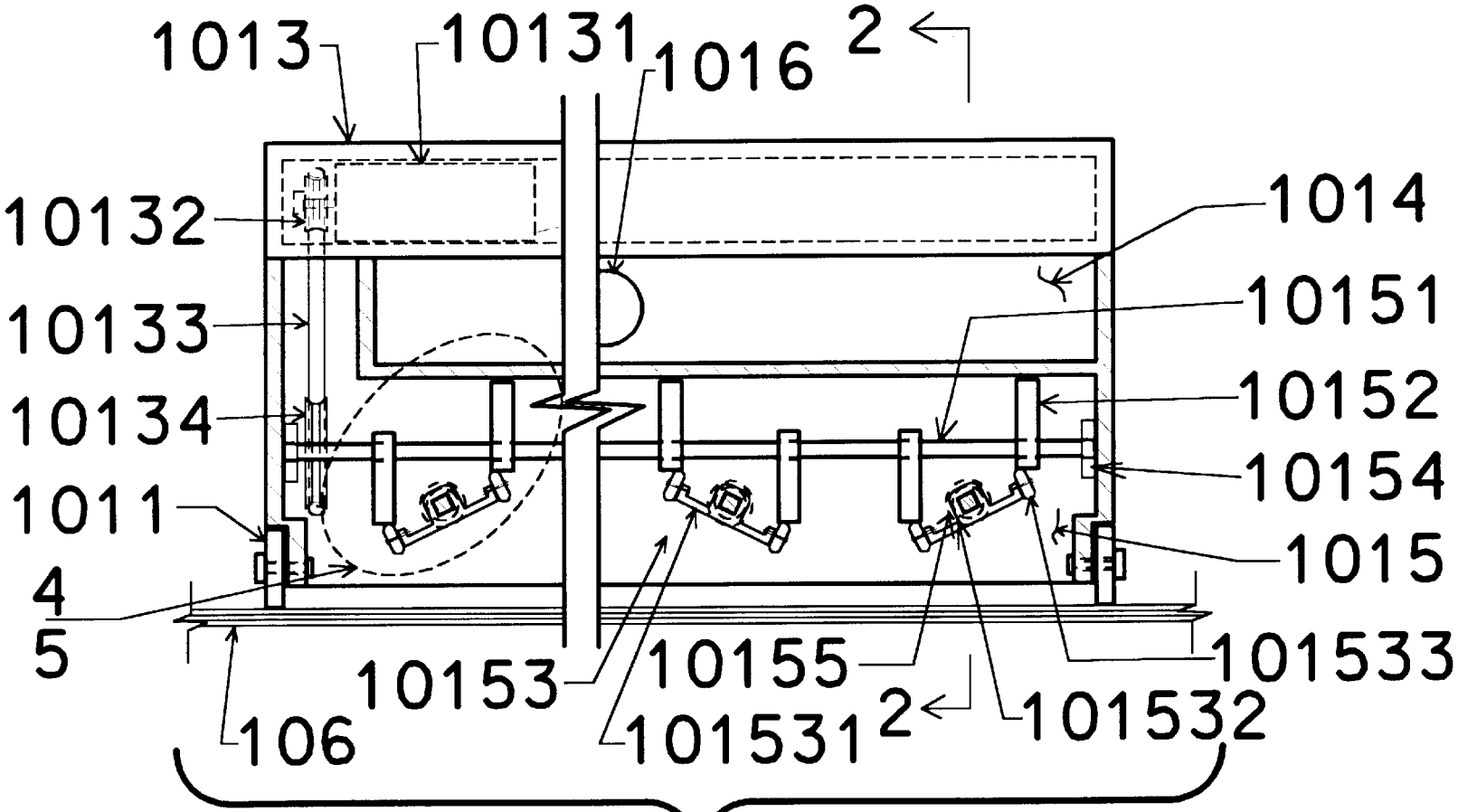
FIG. 3 is another sectional view of the device shown in FIG. 1.

Referring to FIGS. 1, 2 and 3, the first variation of the invented multiple suction nozzle head 1 consists of a suction base 101, several suction heads 102, several suction hoses 103, a hose support/guard frame 104, and several suction head position keepers 105.

The suction head 102 consists of a suction hood 1021, four wheels 1022, two suction head position rod/hood mounting devices 1023, and a dusting brush 1024. The suction hood is basically is an upside down cup with a rectangular or similar cross-section in the front and an elongated tube 1025 in the back. The suction hose 103 is connected to the top wall of the upside down cup of the suction hood. The suction hood's rim has four recessed areas where the four wheels can be mounted. The wheels are so mounted that one side of each of the wheel will flush with the exterior surface of the suction hood and a small gap is kept between the rim of the suction hood and the carpet 106 below. The dusting brush has bristles that are mounted on the dusting brush holder 10241. The dusting brush holder is a short tube with a central hole that has similar cross-section as this of the suction head position rode which will be described later. The suction head position rod/hood mounting devices are bearings mounted on the walls of the suction hood. They are on the two opposite walls that do not have the recessed areas for the wheels. The bearings support the suction head position rod. One of the bearings allows the suction head position rod to penetrate the wall of the suction hood.

The suction base 101 consists of two wheels 1011, a motor/light chamber 1013, a vacuum chamber 1014, and a brush power chamber 1015. The motor/light chamber, the vacuum chamber and the brush power chamber are basically boxes that contain other devices. The brush power chamber may or may not have a bottom. The without bottom one is shown in the figures. The motor/light chamber, the vacuum chamber and the brush power chamber are stacked in order vertically. The wheels 1011 are mounted near the bottom of the brush power chamber on its two opposite walls. The wheels are mounted so that a small gap is kept between the bottom of the brush power chamber and the carpet below.

The suction hose 103 is a flexible tube. One of its ends connects with the backside of the suction hood of the suction head and the other end connects with the vacuum chamber 1014 of the suction base 101.

The vacuum chamber 1014 is a duct manifold with the suction hoses 103 connecting on one side wall and an extension wand connector 1016 on the opposite side wall. The extension wand connector provides a device which can allow a conventional extension wand 1012 and a power cord 10121 to be connected with the invented multiple suction nozzle vacuum head.

The motor/light chamber is a space in which contains an electrical motor 10131, a pulley 10132, a portion of a belt 10133, some electrical wiring (not shown), and an optional light 10135. The electrical motor is mounted on the bottom or sides of the chamber. The pulley is mounted on the axis of the electrical motor. The light is a recessed illumination light which is mounted on the wall of the motor/light chamber. The electrical wiring connects with the power cord 10121 and brings electricity to the electrical motor and the light.

The brush power chamber 1015 contains a brush power transmission rod 10151, many cams 10152, many brush rocking devices 10153, a pair of the brush power transmission rod mounting devices 10154, a pulley 10134, a portion of the belt 10133, and a pair of suction head position rod mounting/penetrating devices 10155. The suction head position rod mounting/penetrating devices are bearings which allow the suction head position rod to penetrate and be mounted on two opposite walls of the brush power chamber. Also referring to FIG. 4, the brush rocking device 10153 consists of a rocking arm 101531, a rocking device/rod connector 101532, and two rocking arm wheels 101533. The rocking arm is a rod with the rocking device/rod connector mounted in the middle. The two rocking arm wheels are wheels that are mounted on the ends of the rocking arm. The rocking device/rod connector is a small plate with a hole on its center. The hole has similar cross-section of that of the suction head position rod 1054. The suction head position rod penetrates the rocking device/rod connector through its hole.

The brush power transmission rod 10151 is a cam shaft. The cams are mounted in pairs on the brush power transmission rod in about 180 degree phase shift. Each cam is working together with one rocking arm wheel of each of the brush rocking device. The brush power transmission rod mounting devices are bearings which are mounted on the opposite interior walls of the brush power chamber. The brush power transmission rod mounting devices are not on the same walls which the suction head position rod mounting/penetrating devices are mounted on. Each end of the brush power transmission rod is anchored by a brush power transmission rod mounting device. The pulley 10134 is mounted near one end of the brush power transmission rod. The belt 10133 engages with this pulley 10134 and the pulley 10132 in the motor/light chamber.

The suction head position keeper 105 consists of a suction head position spring 105 1, a pair of spring supports 1052, a support fastener 1053, a suction head position rod 1054, and a suction head position keeper stopper 1055. The suction head position rod is a rod which penetrates both of the suction head position rod mounting/penetrating device 10155 and one of the suction head position rod/hood mounting device 1023. The suction head position rod can rock freely in the suction head position rod mounting/penetrating device and the suction head position rod/hood mounting device. The suction head position rod can also slide freely in the suction head position rod mounting/penetrating device. The suction head position spring is a spring which both ends are supported by the spring supports 1052 which is a small rack-like object for the end of the spring to rest on. One of the spring support is mounted on the exterior wall of the brush power chamber. The other spring support is mounted on the suction head position rod. The support fastener is either an enlarged portion of the suction head position rod or a device or a pin which can be mounted on the suction head position rod to keep the spring support on the suction head position rod. The suction head position keeper stopper is an enlarged portion at one end of the suction head position rod. The suction head position keeper stopper can prevent the suction head position rod be pushed by the suction head position spring off the suction head position rod mounting/penetrating devices.

The hose support/guard frame 104 consists of two hose guards 1041, a hose support 1042, and many hose support/guard supports 1043. The hose support is a flat plate which is underneath the suction hoses 103 and which support the suction hoses. A hose support/guard support is a rod or a plate. One end of the hose support/guard support is mounted on the exterior wall of the suction base 101. The other end of the hose support/guard support connects with the hose support 1042. The hose guards are two plates or rods extending vertically at the ends of the hose support.

Figure 4:
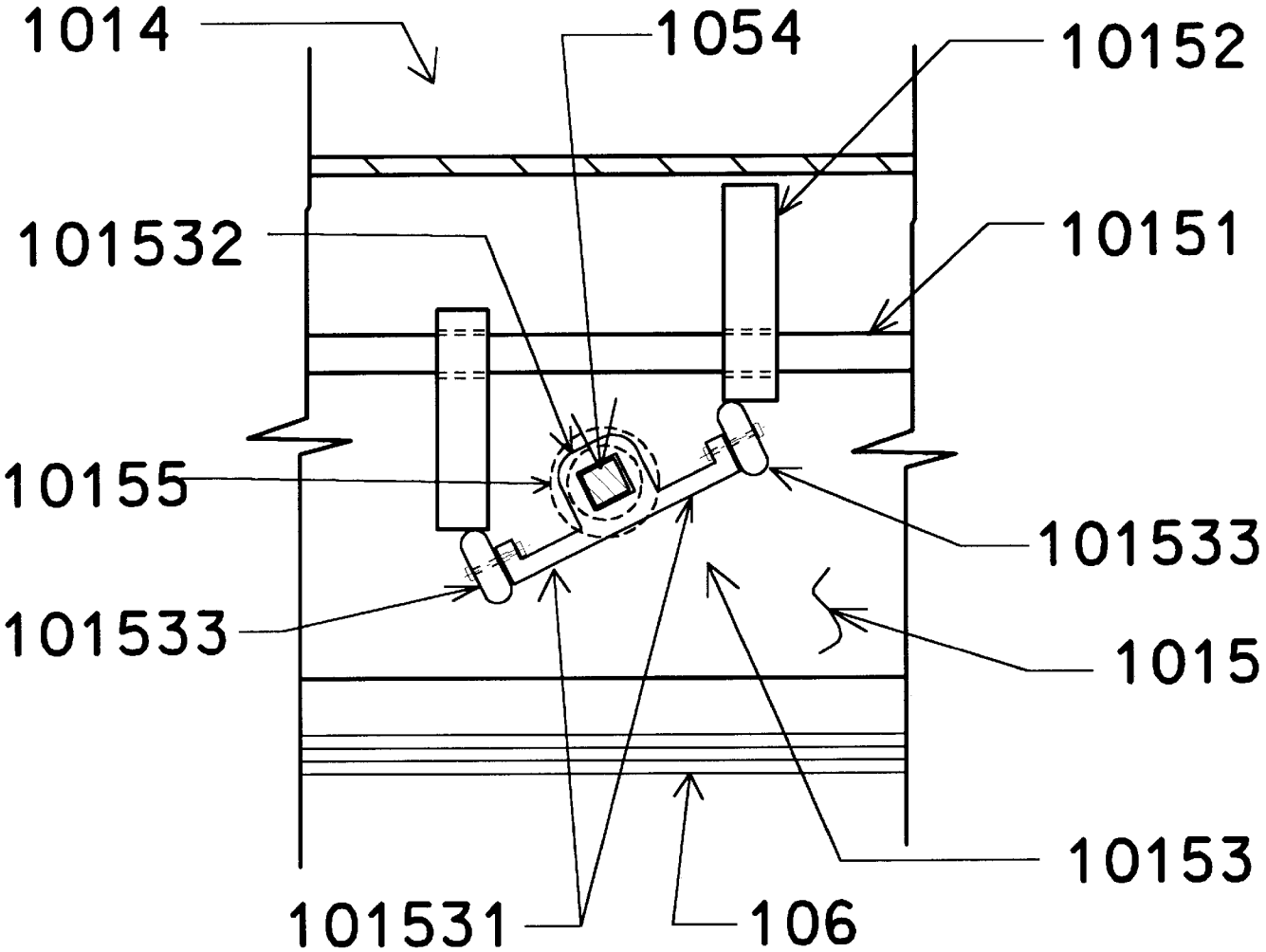
FIG. 4 and FIG. 5 are sectional views which show details and operational functions of a dusting brush rocking device that is shown in FIG. 2 and FIG. 3.
Figure 5:
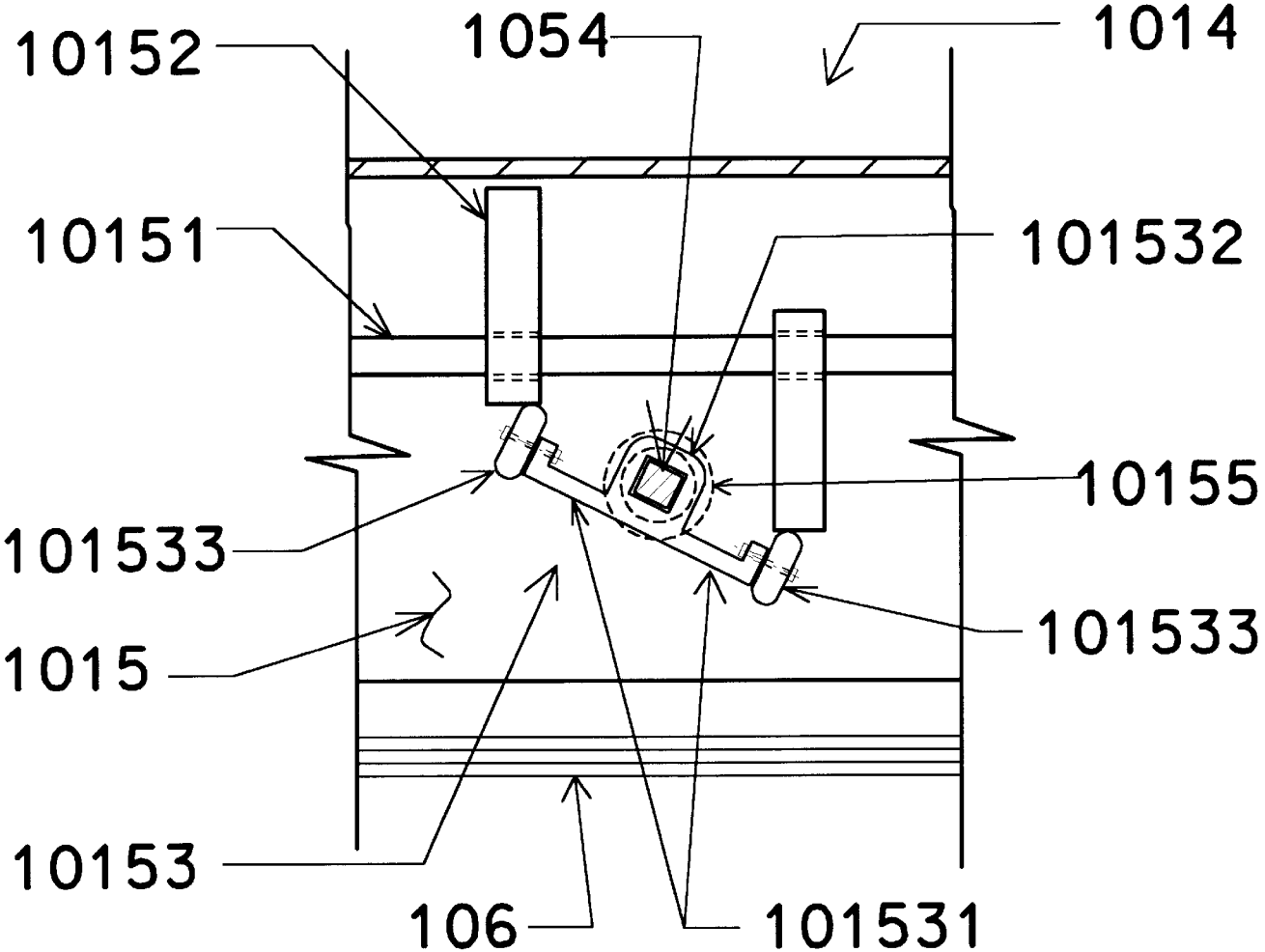
Figure 6:
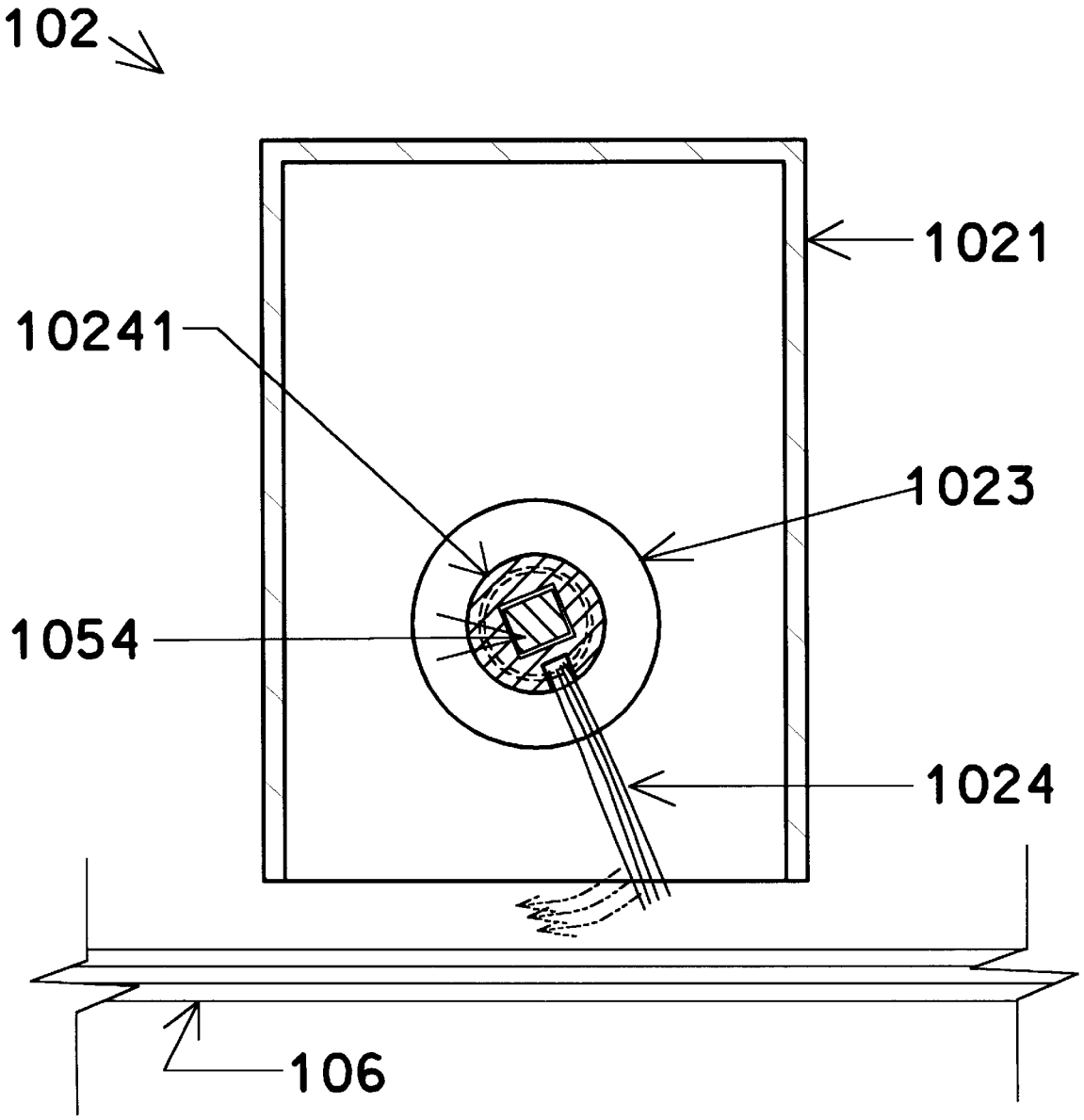
FIG. 6 and FIG. 7 are sectional views that show details and operational functions of a dusting brush which is shown in FIG. 2.
Figure 7:
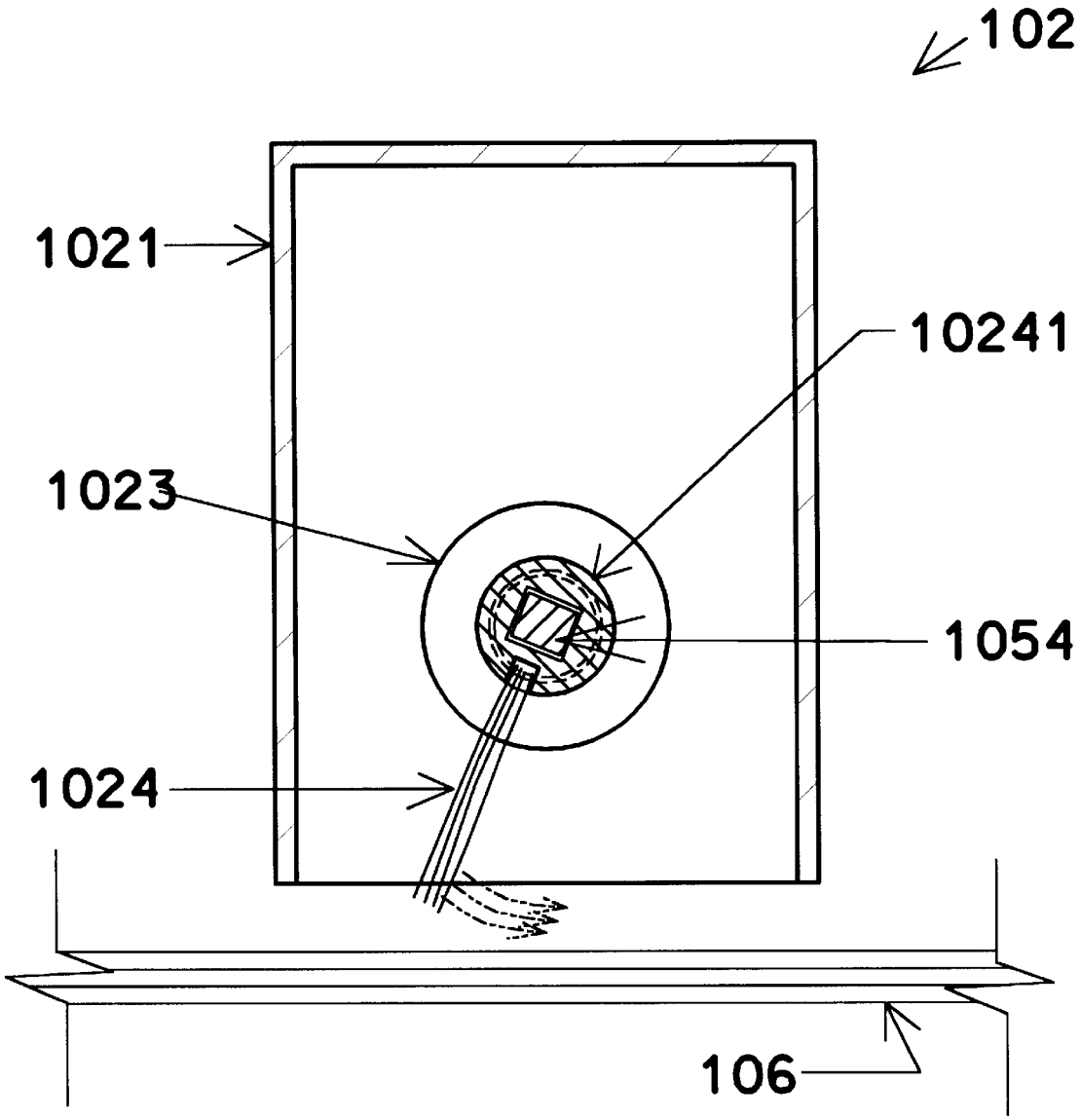

When the power to the invented device is turned on, the electrical motor in the motor/light chamber starts to turn. The pulley 10132 therefore starts to spin. The belt 10133 transfers the rotation energy of the pulley 10132 to the pulley 10134 on the brush power transmission rod 10151. The rotation of the brush power transmission rod causes the cams to spin. Referring to FIGS. 4 and 5, since the cams are in pairs with about 180 degree phase shift, the cams work with the rocking arm wheels 101533 and rock the brush rocking device 10153. The rocking of the brush rocking device causes the suction head position rod 1054 to rock because the suction head position rod engages with the rocking device/rod connector 101532 of the brush rocking device. Referring to FIGS. 6 and 7, the rocking of the suction head position rod 1054 causes the dusting brush 1024 to sweep left and right. Therefore, the dusting brushes will help to disturb the carpet so that it can be vacuumed efficiently.

Figure 8:
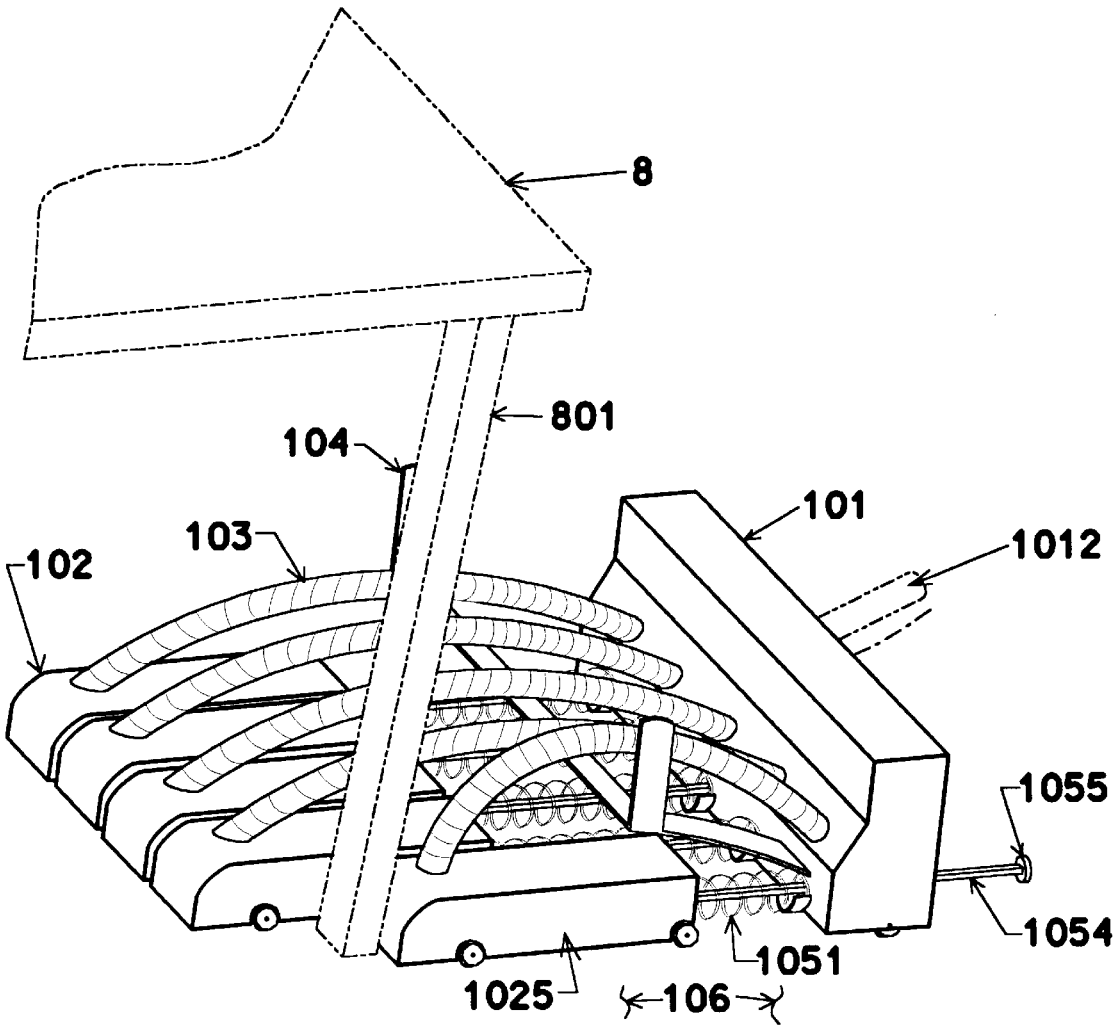
FIG. 8 is an isometric view which illustrates the operational functions of the invented device shown in FIG. 1.

Without meeting obstructions, the invented device works just as an ordinary vacuum head. When vacuuming a carpet floor, a user may pull backwards and push forwards the invented device by the extension wand which is connected to a main body of a vacuum machine. Referring to FIG. 8, when the invented device is being used and when it meets an obstacle 801, such as a leg of a table 8, a number of the suction heads may be stopped by the obstacle while the rest suction heads may be pushed forward beyond the obstacle. Shown in FIG. 8, only one suction head is stopped by the obstacle. When a suction head is stopped by an obstacle while the rest suction heads are moving forwards, the suction head position spring 1051 which associates with the stopped suction head is compressed and shortened. The suction head position rod 1054 which is associated with the stopped suction head is pushed backwards and the suction head position rod and its suction head position keeper stopper 1055 will be pushed backwards and extrudes on the back side of the suction base. The elongated tube 1025 of the suction head will provide guide for the adjacent suction heads which are not stopped by the obstacles. The elongated tube will keep the back sides of the other suction heads from being tangled with the obstacle when the invented device is pulled back from the obstacle. When the invented device is pulled back from the obstacle, the suction head position spring 1051 will push the stopped suction head to its original position which will be on the same line of the rest suction heads.

Two additional variations of the means which can cause dusting brushes to rock are shown in FIGS. 9, 10 and 11, 12, respectively. Since the variations are the components of the invented suction base, the same numbering system which is used to describe the other components of the brush power chamber is used for the descriptions of these variations. Instead of using two cams to work with a brush rocking device which are shown in FIGS. 3, 4 and 5, one variation of the brush rocking means needs only one cam to work with a single wheeled spring loaded brush rocking device. The other variation of the brush rocking means also needs only one cam to work with a single wheeled counter weighted brush rocking device.

Figure 9:
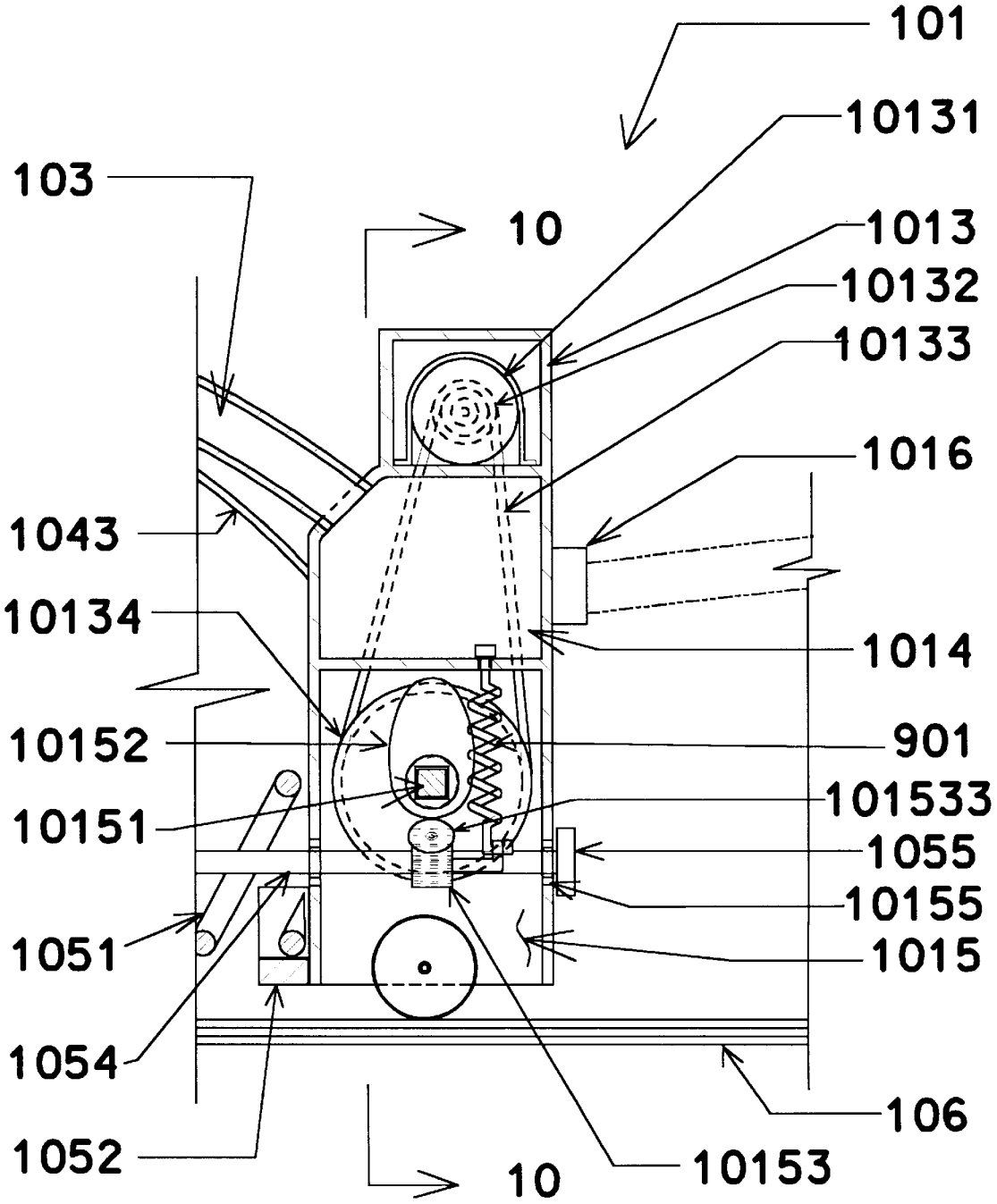
FIG. 9 is a sectional view of a variation of a dusting brush rocking device.
Figure 10:
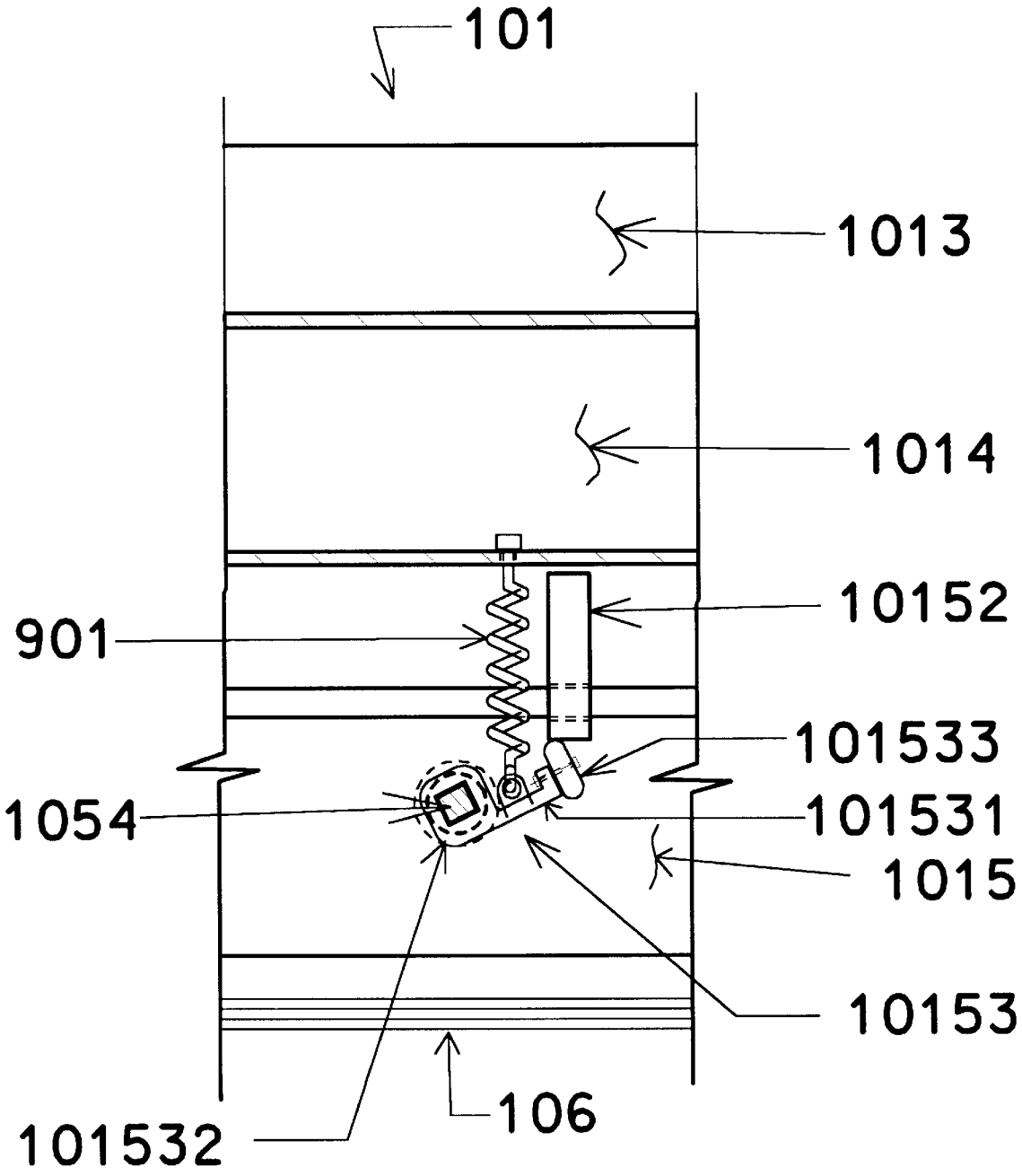
FIG. 10 is a sectional view of the dusting brush rocking device shown in FIG. 9.

Referring to FIGS. 9 and 10, the variation of the brush rocking means which needs only one cam to work with a single wheeled spring loaded brush rocking device is located in the brush power chamber 1015 which contains a brush power transmission rod 10151, many cams 10152, many brush rocking devices 10153, a pair of the brush power transmission rod mounting devices (not shown), a pulley 10134, a portion of the belt 10133, and a pair of suction head position rod mounting/penetrating devices 10155. Other than the brush rocking devices, the other components of the brush power chamber are the same as those described previously and their descriptions will not be repeated herein. The brush rocking device 10153 consists of a rocking arm 101531, a rocking device/rod connector 101532, a spring 901, and a rocking arm wheels 101533. The rocking arm is a rod with the rocking device/rod connector mounted near one of its ends. The rocking arm wheel is a wheel that is mounted on the other end of the rocking arm. The rocking device/rod connector is a small plate with a hole on its center. The hole has similar cross-section of that of the suction head position rod 1054. The suction head position rod penetrates the rocking device/rod connector through its hole. One end of the spring connects with the rocking arm. The other end of the spring connects with the frame or wall of the brush power chamber.

When the power to the invented device is turned on, the electrical motor in the motor/light chamber starts to turn. The pulley 10132 therefore starts to spin. The belt 10133 transfers the rotation energy of the pulley 10132 to the pulley 10134 on the brush power transmission rod 10151. The rotation of the brush power transmission rod causes the cams to spin. The cams push out the rocking arm wheels 101533 while the springs pull back the rocking arm wheels. This will rock the brush rocking device 10153. The rocking of the brush rocking device causes the suction head position rod 1054 to rock because the suction head position rod engages with the rocking device/rod connector 101532 of the brush rocking device. The rocking of the suction head position rod 1054 causes the dusting brush to sweep left and right.

Figure 11:
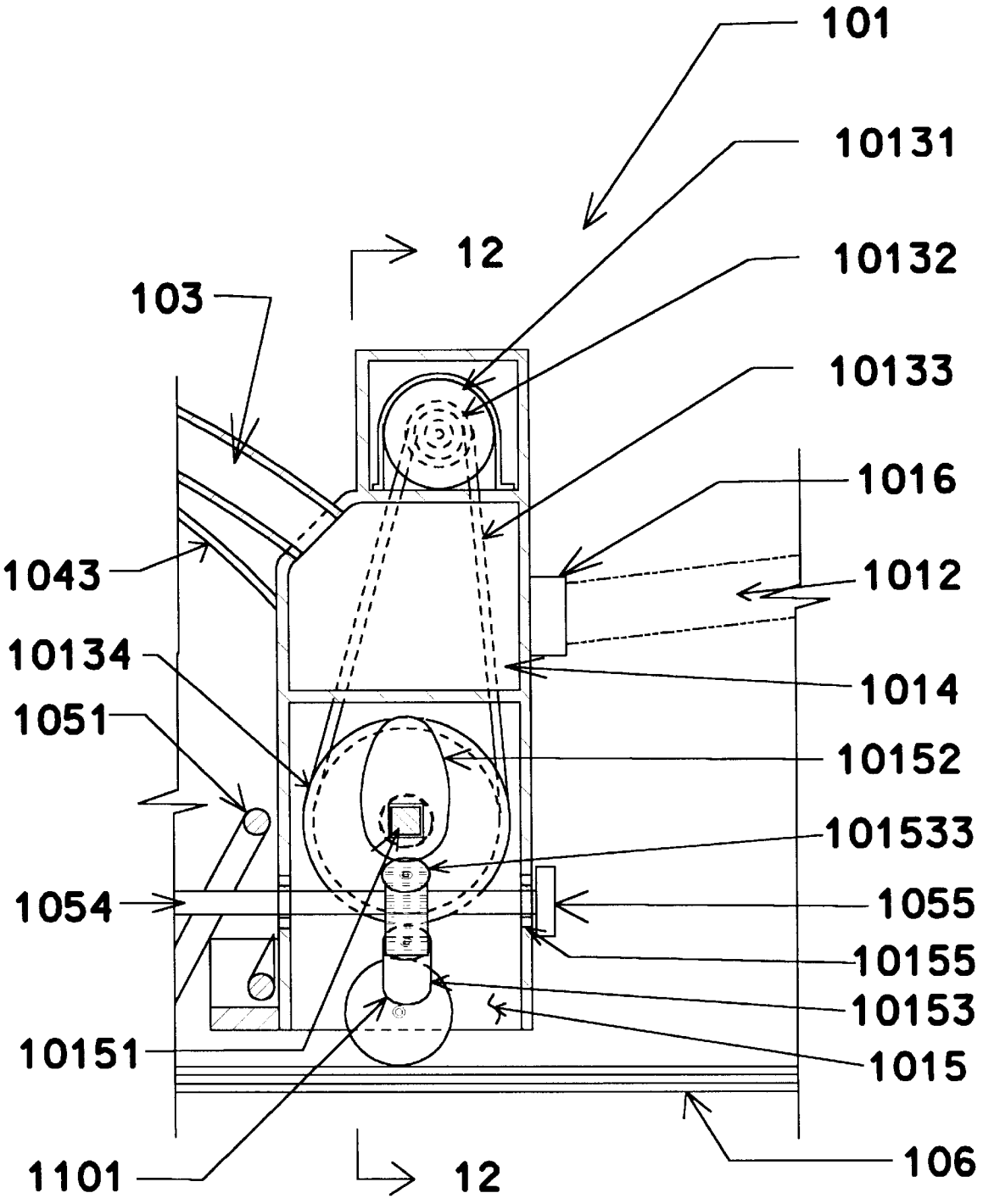
FIG. 11 is a sectional view of another variation of a dusting brush rocking device.
Figure 12:
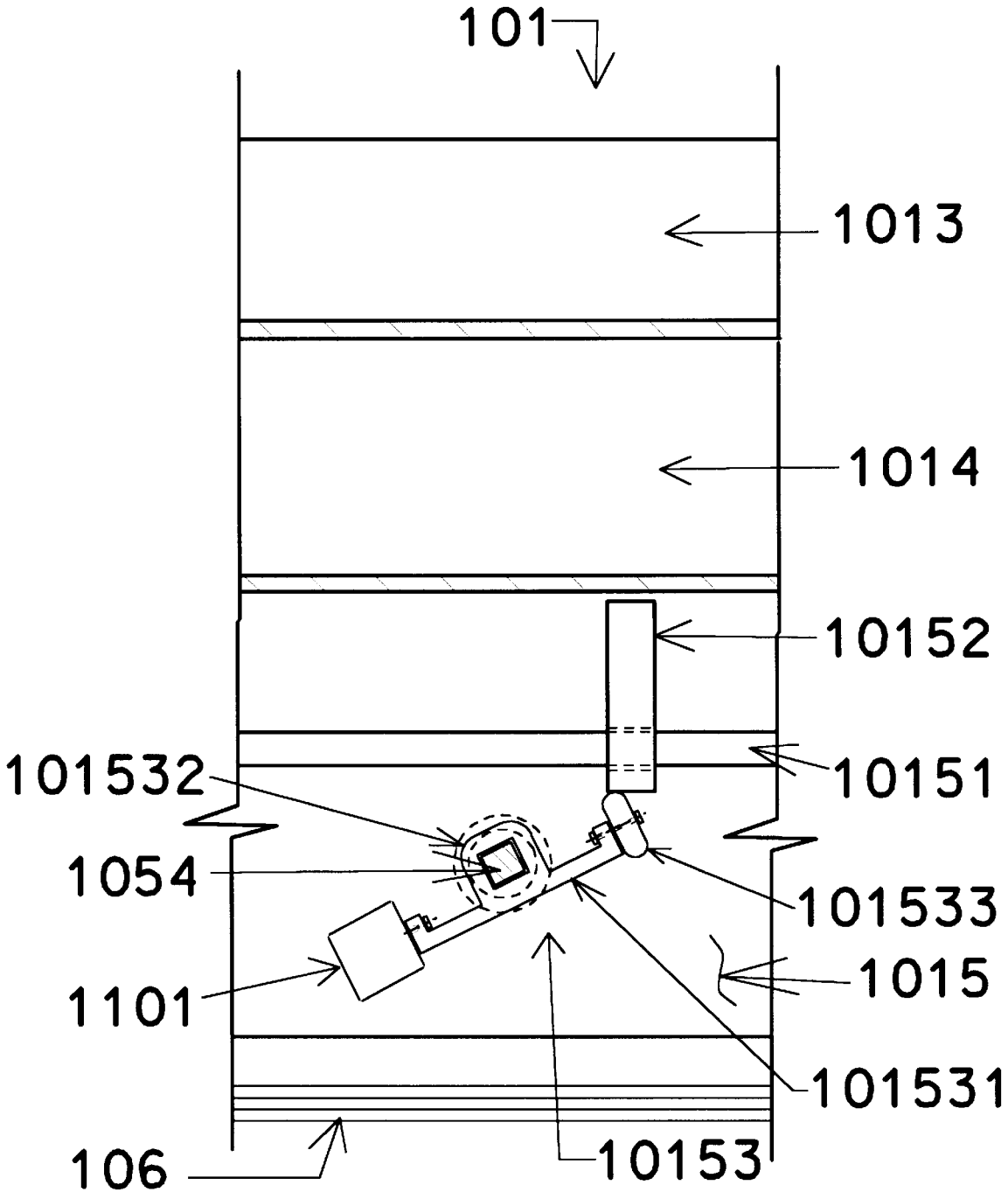
FIG. 12 is a sectional view of the dusting brush rocking device shown in FIG. 11.

Referring to FIGS. 11 and 12, the variation of the brush rocking means which needs only one cam to work with a single wheeled counter weighted brush rocking device is located in the brush power chamber 1015 which contains a brush power transmission rod 10151, many cams 10152, many brush rocking devices 10153, a pair of the brush power transmission rod mounting devices (not shown), a pulley 10134, a portion of the belt 10133, and a pair of suction head position rod mounting/penetrating devices 10155. Other than the brush rocking devices, the other components of the brush power chamber are the same as those described previously and their descriptions will not be repeated herein. The brush rocking device 10153 consists of a rocking arm 101531, a rocking device/rod connector 101532, a counter weight 1101, and a rocking arm wheels 101533. The rocking arm is a rod with the rocking device/rod connector mounted near its middle. The rocking arm wheel is a wheel that is mounted on one end of the rocking arm. The counter weight is a weight mounted on the other end of the rocking arm. The rocking device/rod connector is a small plate with a hole on its center. The hole has similar cross-section of that of the suction head position rod 1054. The suction head position rod penetrates the rocking device/rod connector through its hole.

When the power to the invented device is turned on, the electrical motor in the motor/light chamber starts to turn. The pulley 10132 therefore starts to spin. The belt 10133 transfers the rotation energy of the pulley 10132 to the pulley 10134 on the brush power transmission rod 10151. The rotation of the brush power transmission rod causes the cams to spin. The cams push out the rocking arm wheels 101533 while the counter weights push back the rocking arm wheels. This will rock the brush rocking device 10153. The rocking of the brush rocking device causes the suction head position rod 1054 to rock because the suction head position rod engages with the rocking device/rod connector 101532 of the brush rocking device. The rocking of the suction head position rod 1054 causes the dusting brush to sweep left and right.

Figure 13:
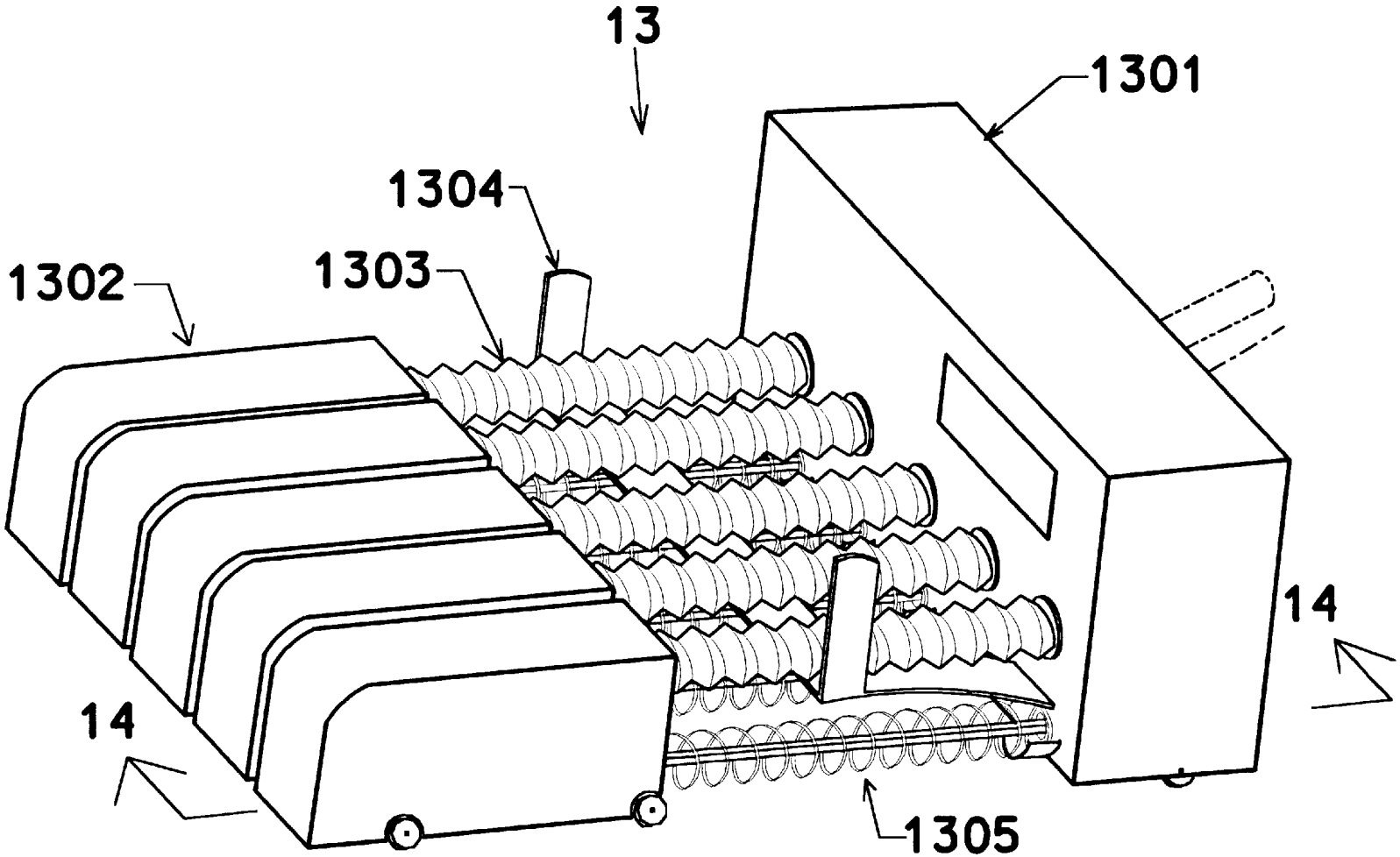
FIG. 13 is an isometric view of the second variation of the invented device.
Figure 14:
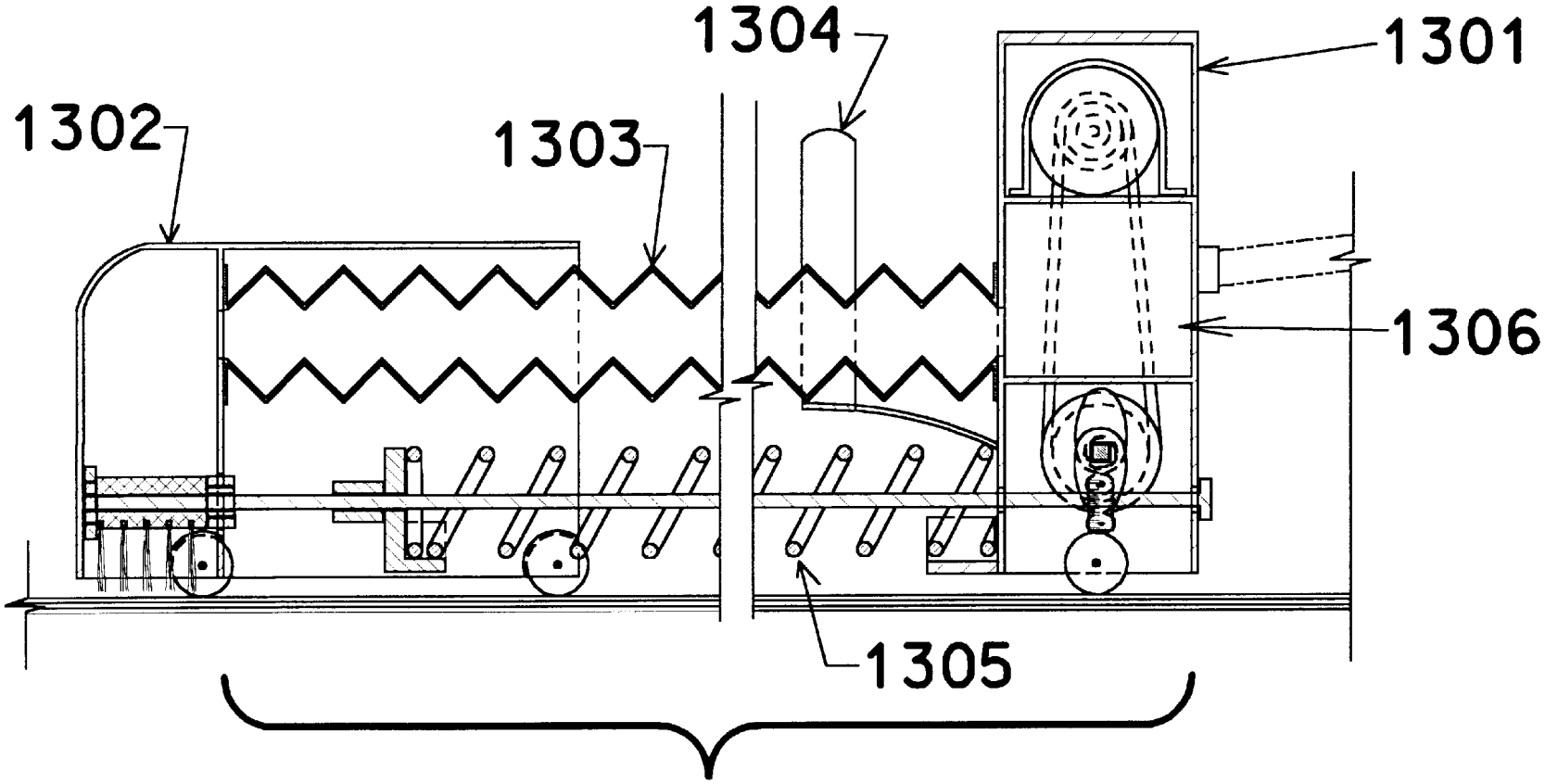
FIG. 14 is a sectional view of the device shown in FIG. 13.

Referring to FIGS. 13 and 14, the second variation of the invented multiple suction nozzle head 13 consists of a suction base 1301, several suction heads 1302, several suction hoses 1303, a hose support/guard frame 1304, and several suction head position keepers 1305.

The suction base, the suction head, the hose support/guard frame and the suction head position keeper are similar to those described previously for the first variation of the invented device and are not described herein again. The main differences between the first variation and the second variation of the invented devices are the suction hoses and their connection points.

The suction hose 1303 for the second variation is a flexible bellow tube. One of its ends connects with the backside of the suction head 1302 and the other end connects with the vacuum chamber 1306 of the suction base 1301.

Figure 15:
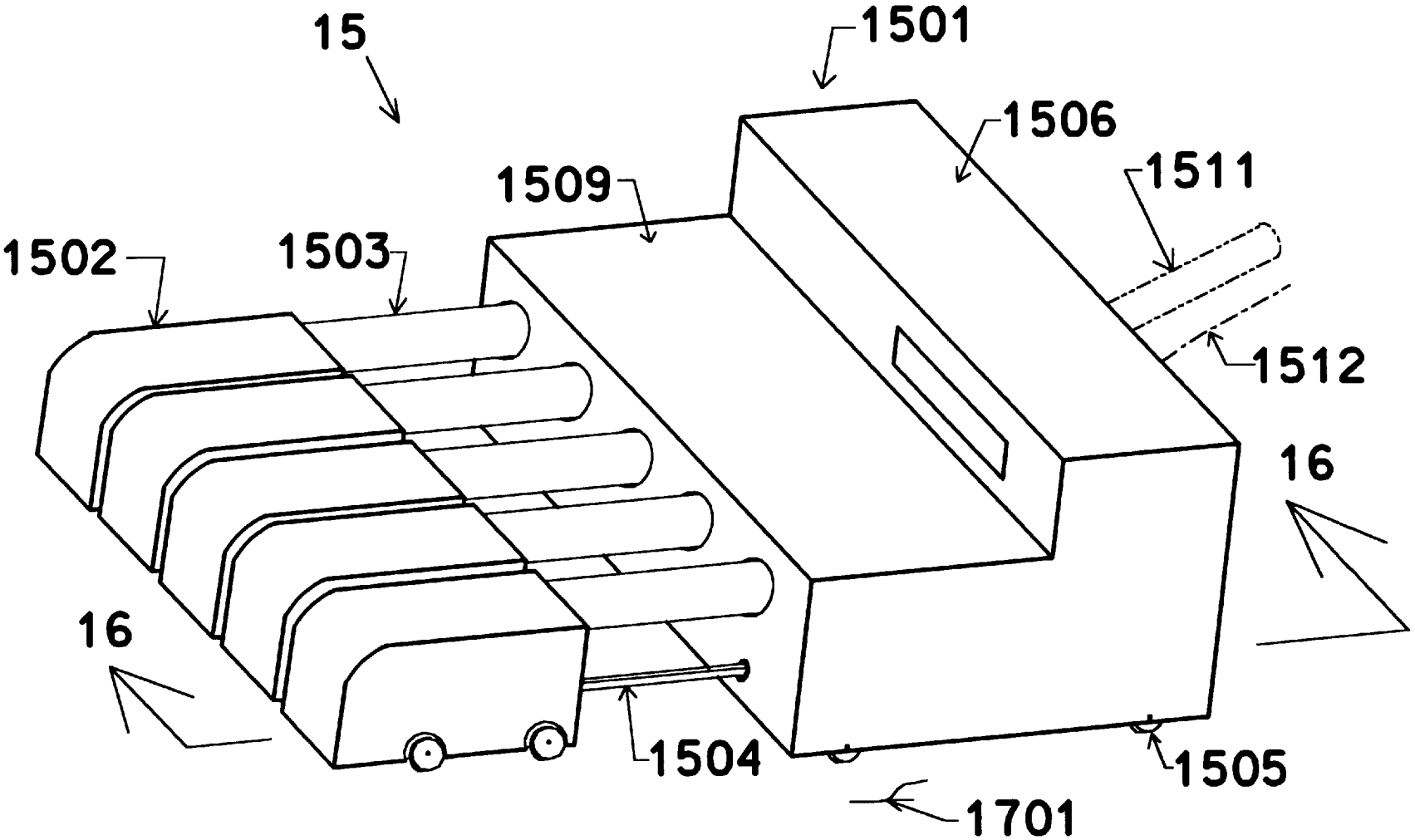
FIG. 15 is an isometric view of the third variation of the invented device.
Figure 16:
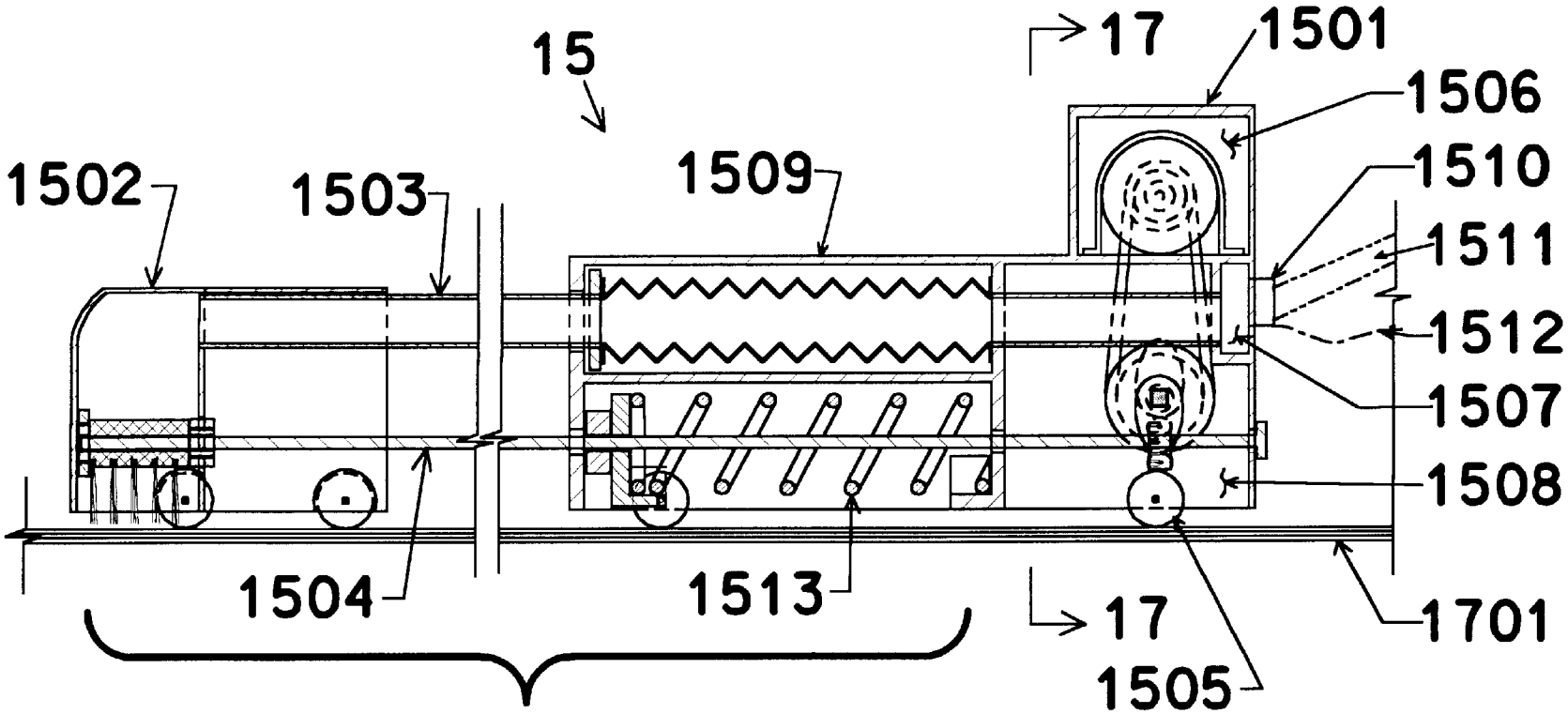
FIG. 16 is a sectional view of the device shown in FIG. 15.
Figure 17:
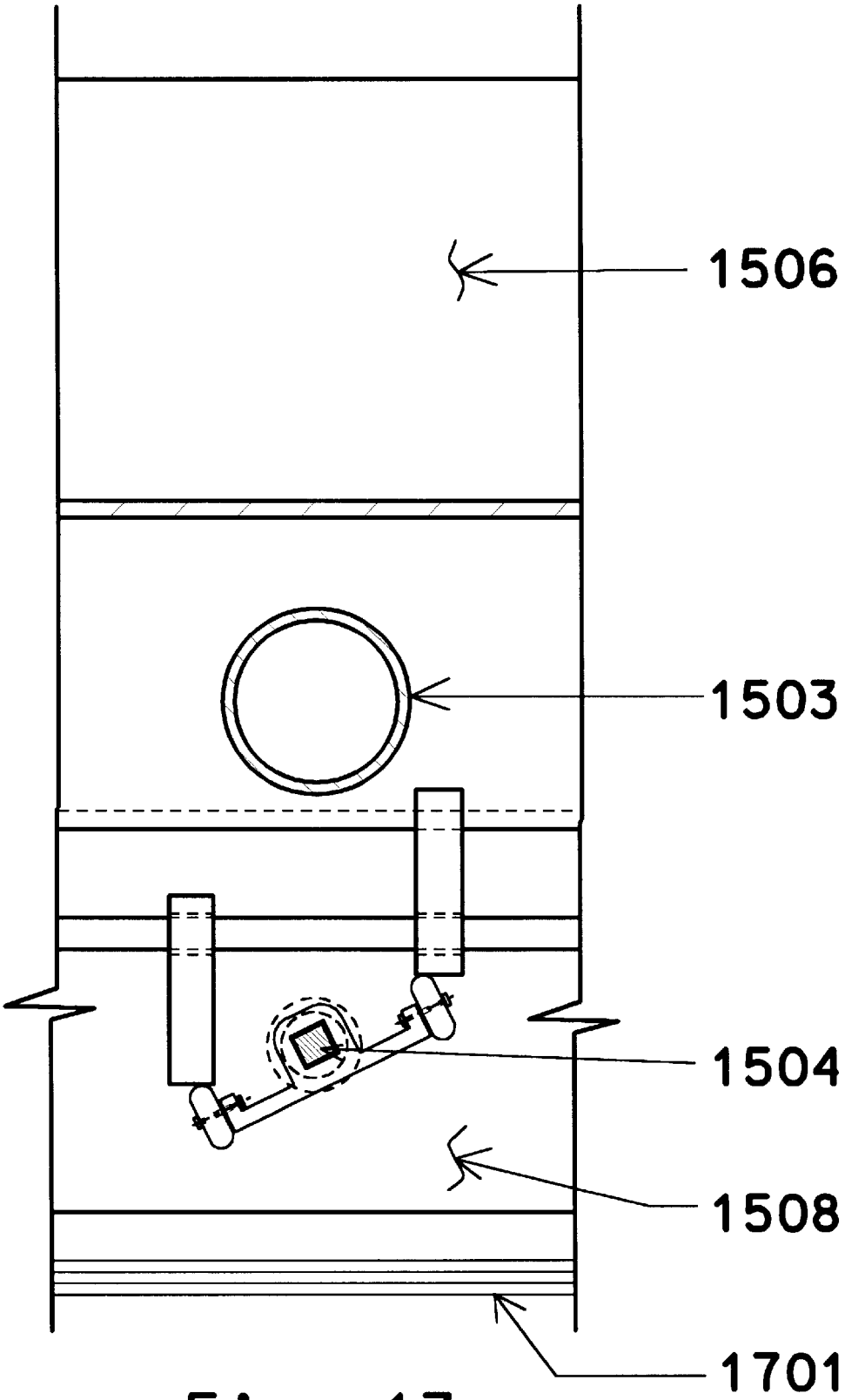
FIG. 17 is a sectional view of the device shown in FIG. 16.

Referring to FIGS. 15, 16 and 17, the third variation of the invented multiple suction nozzle head 15 consists of a suction base 1501, several suction heads 1502, several suction tubes 1503, and several suction head position rods 1504.

The suction head 1502 is the same as that of the first and second variation of the invented devices and contains the same apparatuses.

The suction base 1501 consists of four wheels 1505, a motor/light chamber 1506, a vacuum chamber 1507, a brush power chamber 1508, and a bellow/spring chamber 1509. The motor/light chamber, the vacuum chamber, the bellow/spring chamber and the brush power chamber are basically boxes that contain many devices. The brush power chamber and the bellow/spring chamber may or may not have a bottom. The without bottom one is shown in the figures. The motor/light chamber is above the vacuum chamber and the brush power chamber. The vacuum chamber is on the backside of the brush power chamber. The bellow/spring chamber is on the front side of the brush power chamber. The wheels 1505 are mounted near the bottom of the brush power chamber and the bellow/spring chamber on its two opposite walls. The wheels are mounted so that a small gap is kept between the bottom of the brush power chamber and the carpet 1701 below.

The suction tube 1503 consists of two rigid tubes with a flexible bellow tube in between. One of the ends of the suction tube connects with the backside of the suction hood of the suction head 1502 and the other end connects with the vacuum chamber 1507 of the suction base 1501. The bellow tube is inside the upper portion of the bellow/spring chamber 1509.

The vacuum chamber 1507 is a duct manifold with the suction hoses 1503 on one side-wall and an extension wand connector 1510 on the opposite sidewall.

The extension wand connector provides a device which can allow a conventional extension wand 1511 and a power cord 1512 to be connected with the invented multiple suction nozzle vacuum head.

The motor/light chamber and the brush power chamber contain similar devices as these described for the first and second variations of the invented devices. The suction head position rod is similar to those described for the aforementioned variations of the invented devices. The spring 1513 which is mounted on the suction head position rod 1504 is located inside the lower portion of the bellow/spring chamber.

Figure 18:
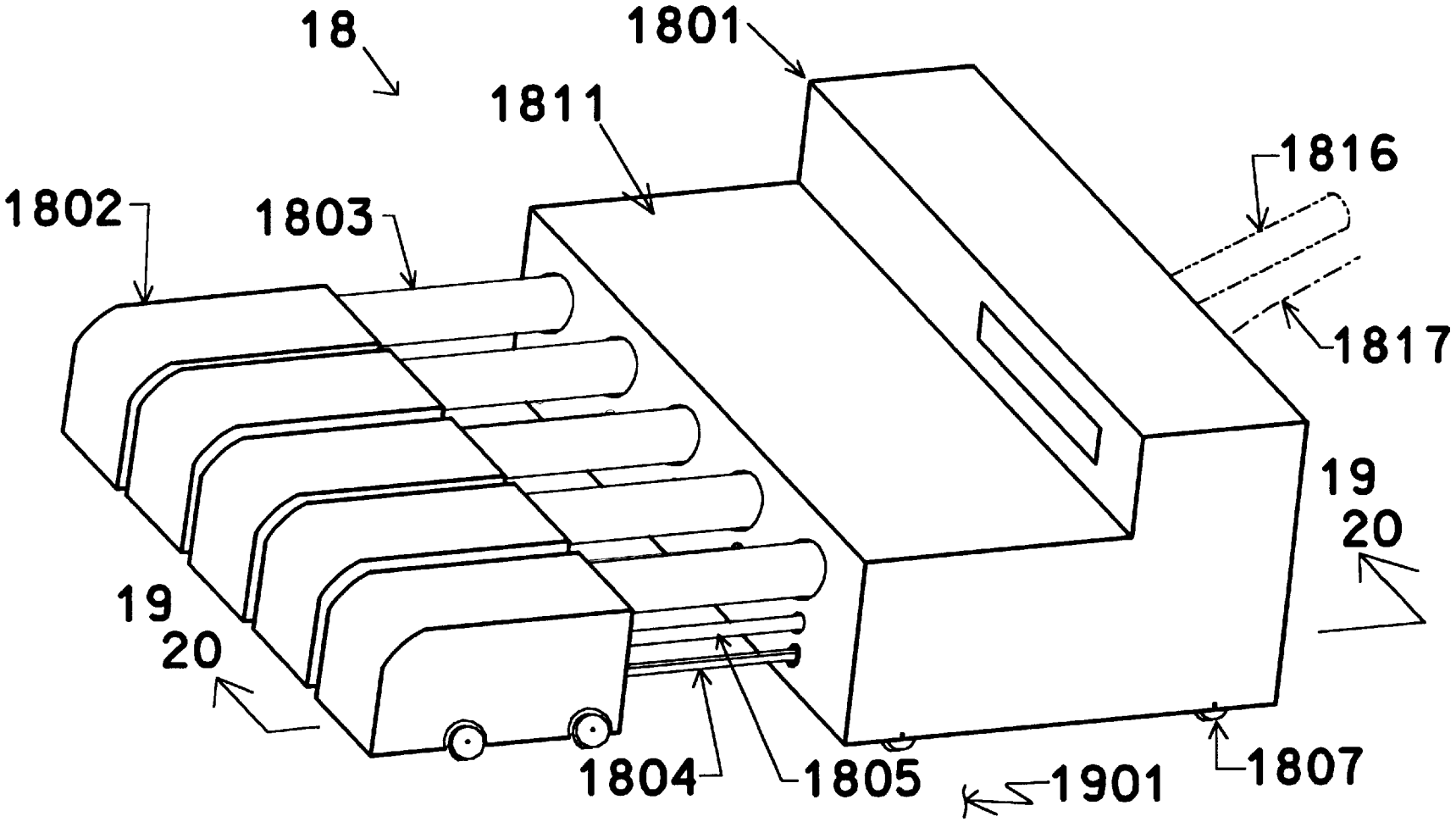
FIG. 18 is an isometric view of the fourth variation of the invented device.
Figure 19:
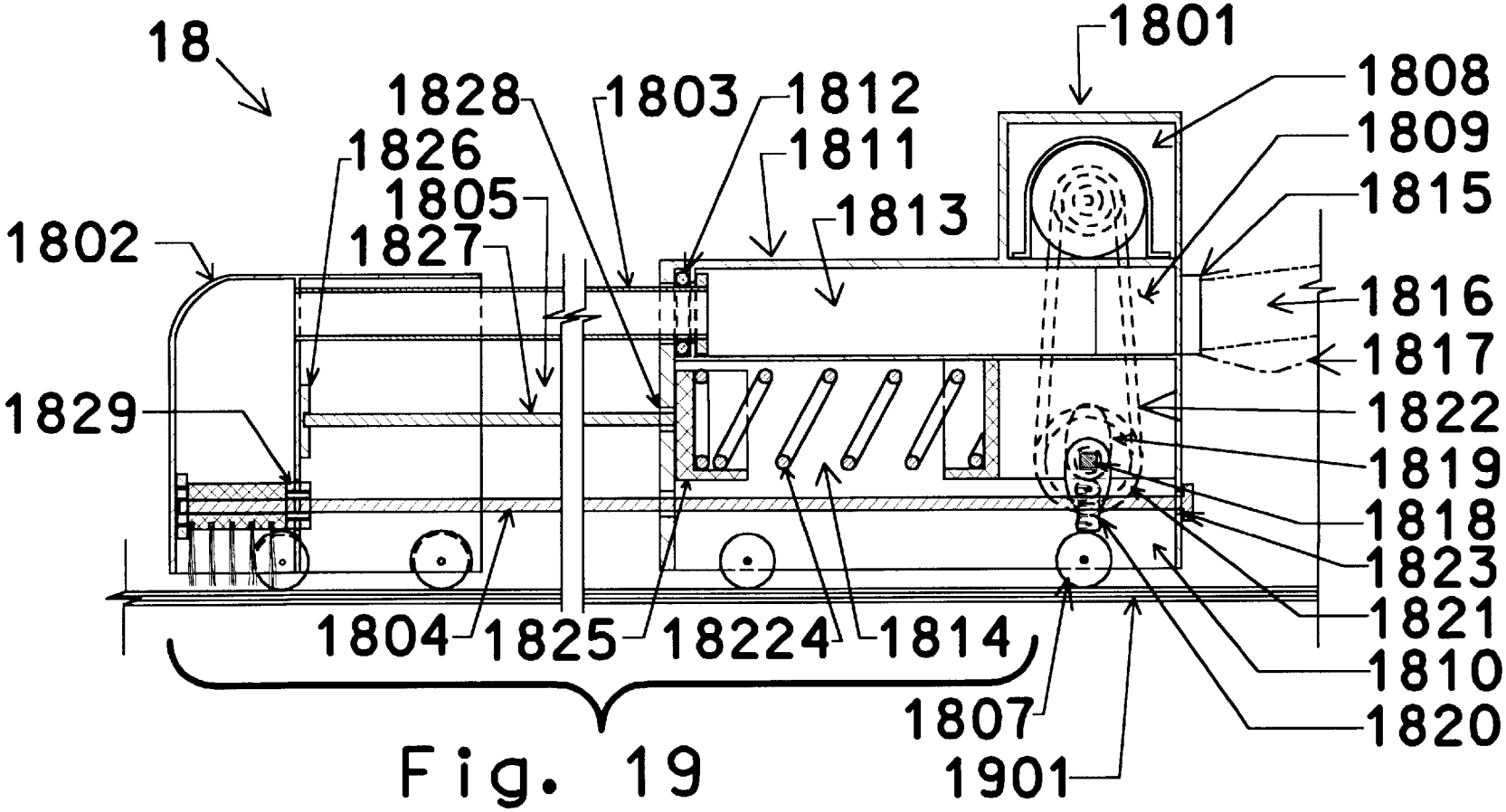
FIG. 19 is a sectional view of a sub-variation of the device shown in FIG. 18.
Figure 20:
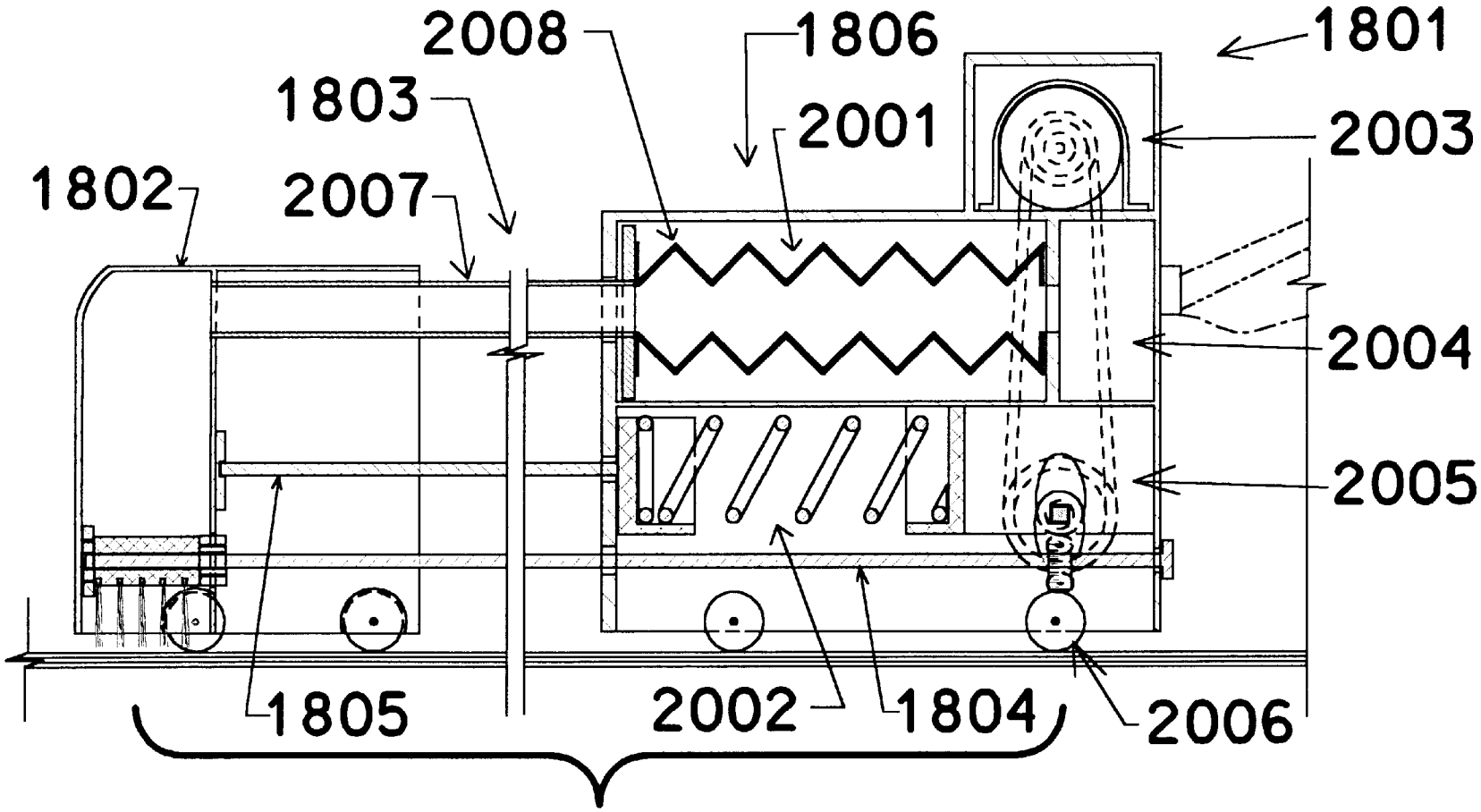
FIG. 20 is a sectional view of the other sub-variation of the device shown in FIG. 18.

The fourth variation of the invented multiple suction nozzle vacuum heads has two sub-variations. Referring to FIGS. 18, 19 and 20, the fourth variation of the invented multiple suction nozzle head 18 consists of a suction base 1801, several suction heads 1802, several suction tubes 1803, several dusting brush rocking rods 1804, and several suction head position keepers 1805. FIG. 19 shows one sub-variation while FIG. 20 shows the other.

The suction head 1802 is the same as that of the previously described variations of the invented devices.

Referring to FIG. 19, the suction base 1801 of the first sub-variation of the fourth variation of the invented devices consists of four wheels 1807, a motor/light chamber 1808, a vacuum chamber 1809, a brush power chamber 1810, and a piston/spring chamber 1811. The motor/light chamber, the vacuum chamber, the piston/spring chamber and the brush power chamber are basically boxes that contain many devices. The brush power chamber and the piston/spring chamber may or may not have a bottom. The without bottom ones are shown in FIG. 19. The motor/light chamber is above the vacuum chamber and the brush power chamber. The vacuum chamber is on the upper backside of the brush power chamber. The piston/spring chamber is on the front side of the brush power chamber. The wheels 1807 are mounted near the bottom of the brush power chamber and the bellow/spring chamber and are on their two opposite walls. The wheels are mounted so that a small gap is kept between the bottom of the brush power chamber and the carpet 1901 below.

The piston/spring chamber 1811 consists of many piston chambers 18 13 and many spring chambers 1814. The piston chamber is a tube with a "O"-ring seal 1812 at one of its ends. The other end of the piston chamber connects with the vacuum chamber. The spring chamber is below the piston chamber.

The suction tube 1803 is a rigid tube with an enlarged end. Its end without the enlarged end connects with the backside of the suction hood of the suction head 1802. Its other end with the enlarged end is inside the piston chamber 1813. The "O"-ring provides seal while the suction tube slides like a piston inside the piston chamber.

The vacuum chamber 1809 is a duct manifold with the piston chamber connecting on one sidewall and an extension wand connector 1815 on the opposite sidewall.

The extension wand connector provides a device which can allow a conventional extension wand 1816 and a power cord 1817 to be connected with the invented multiple suction nozzle vacuum head.

The motor/light chamber contains similar devices as these described for the first, second and third variations of the invented devices.

Referring to FIG. 19, the brush power chamber 1810 contains a brush power transmission rod 1818, many cams 1819, many brush rocking devices 1820, a pair of the brush power transmission rod mounting devices (not shown), a pulley 1821, a portion of the belt 1822, and many dusting brush rocking rod mounting/penetrating devices 1823. The dusting brush rocking rod mounting/penetrating devices are bearings which allow the dusting brush rocking rods to penetrate and be mounted on the walls of the brush power chamber and the piston/spring chamber. The cams, the brush rocking devices, the brush power transmission rods, the pulley, the belt, and the brush power transmission rod mounting devices have the same constructions and characteristics as those described previously for the first, second and third variations of the invented devices.

The suction head position keeper 1805 consists of a suction head position spring 18224, a pair of spring supports 1825, a support fastener 1826, a suction head position rod 1827, and a suction head position rod mounting/penetrating device 1828. The suction head position rod is a rod which penetrates the suction head position rod mounting/penetrating device which is a bearing on the wall of the spring chamber. One end of the suction head position rod connects with a spring support. The other end of the suction head position rod connects with the support fastener which is a bearing mounted on the backside of the suction cup of the suction head. The suction head position rod can slide freely in the suction head position rod mounting/penetrating device. The suction head position spring is a spring which both ends are supported by the spring supports. One of the spring supports is mounted on the exterior wall of the brush power chamber. The suction head position spring is a spring fixed in place by the two spring supports.

The dusting brush rocking rod 1804 is a rod which penetrates the dusting brush rocking rod mounting/penetrating devices and one of the suction head position rod/hood mounting device 1829. The dusting brush rocking rod can rotate freely in the dusting brush rocking rod mounting/penetrating device and the suction head position rod/hood mounting device. The dusting brush rocking rod can also slide freely in the dusting brush rocking rod mounting/penetrating device. One end of the dusting brush rocking rod has an enlarged portion which can prevent the dusting brush rocking rod be pushed by the suction head position spring off the dusting brush rocking rod mounting/penetrating device.

Referring to FIG. 20, the suction base 1801 of the second sub-variation of the fourth variation of the invented devices consists of four wheels 2006, a motor/light chamber 2003, a vacuum chamber 2004, a brush power chamber 2005, and a bellow/spring chamber 1806. The wheels, the motor/light chamber, the vacuum chamber, and the brush power chamber are the same as those described for the first sub-variation of the fourth variation of the invented devices.

The bellow/spring chamber consists of many bellow chambers 2001 and many spring chambers 2002.

The suction tube 1803 consists of a rigid tube 2007 connecting with a bellow tube 2008. One end of the rigid tube connects with the backside of the suction hood of the suction head. One end of the bellow tube connects with the vacuum chamber. The bellow tube is inside of the bellow/spring chamber.

The vacuum chamber, the motor/light chamber contains similar devices as these described for the first, second and third variations of the invented devices.

The dusting brush rocking rod and the suction head position keeper are the same as those described for the first sub-variation of the fourth variation of the invented devices.

The use of the second, the third and the fourth variations of the invented devices are the same as that of the first variation of the invented devices.

Figure 21:
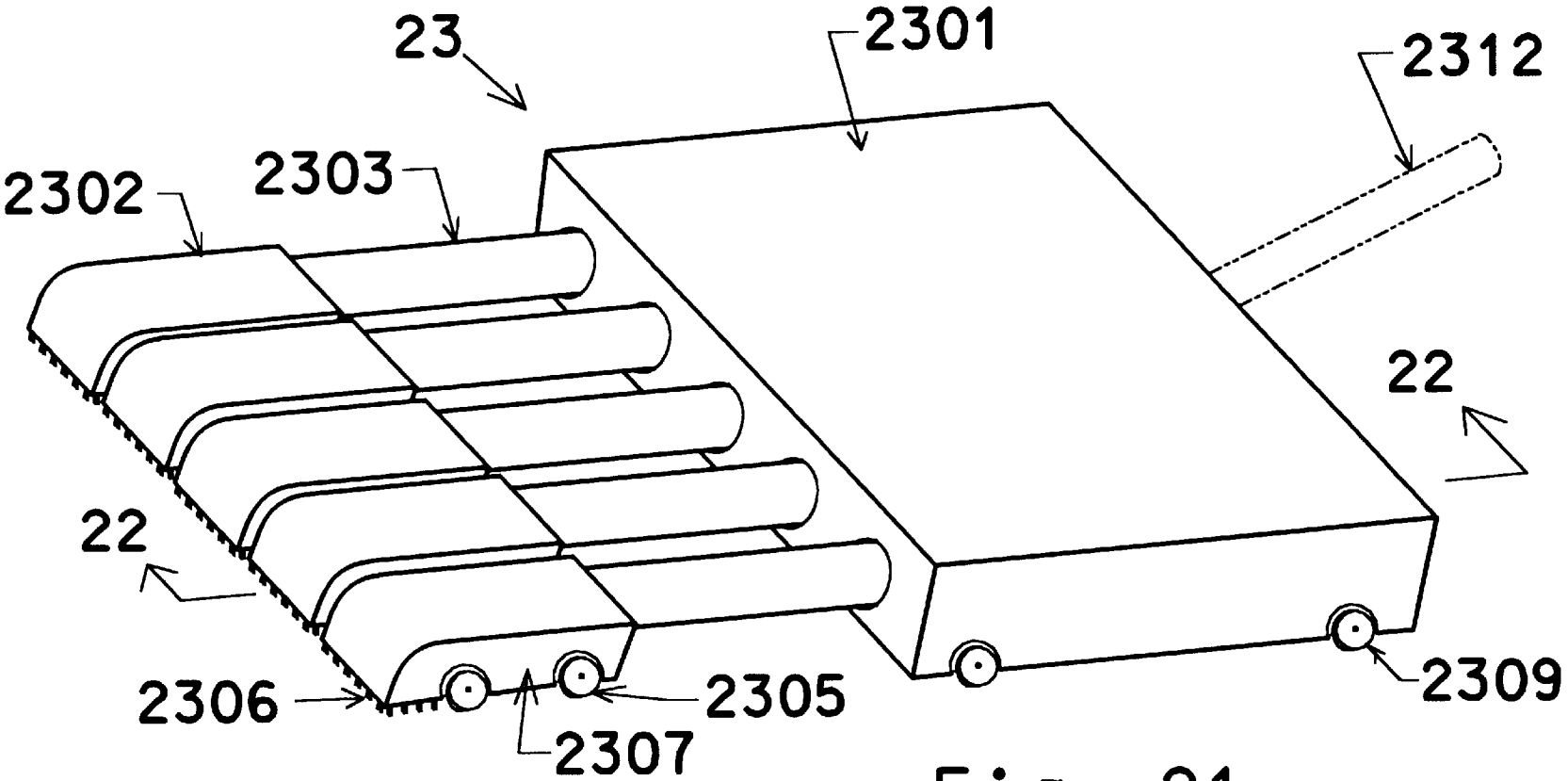
FIG. 21 is an isometric view of the first sub-variation of the fifth variation of the invented device.
Figure 22:
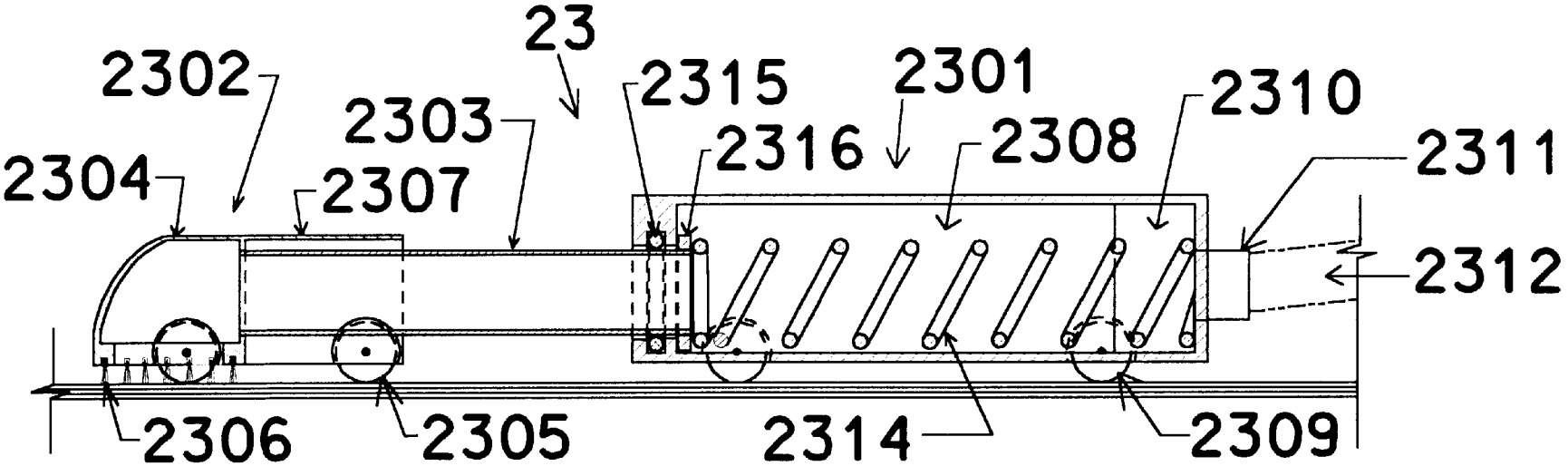
FIG. 22 is a sectional view of the device shown in FIG. 21.

There are two sub-variations of the fifth variation of the invented devices. Referring to FIGS. 21 and 22, the first sub-variation of the fifth variation of the invented multiple suction nozzle head 23 consists of a suction base 2301, several suction heads 2302, and several suction tubes 2303.

The suction head 2302 consists of a suction hood 2304, four wheels 2305, and many dusting brushes 2306. The suction hood is basically is an upside down cup with a rectangular or similar cross-section in the front and an elongated tube 2307 in the back. The suction tube 2303 is connected to the back wall of the upside down cup of the suction hood. The suction hood's rim has four recessed areas where the four wheels can be mounted. The wheels are so mounted that one side of each of the wheel will flush with the exterior surface of the suction hood and a small gap is kept between the rim of the suction hood and the carpet below. The dusting brush are bristles that are mounted on the rim of the suction hood.

The suction base 2301 consists of four wheels 2309, many spring chambers 2308 and a vacuum chamber 2310. The vacuum chamber is a duct manifold with the spring chamber connecting on one sidewall and an extension wand connector 2311 on the opposite sidewall. The extension wand connector provides a device which can allow a conventional extension wand 2312 to be connected with the invented multiple suction nozzle vacuum head. A spring chamber is basically a duct with a spring 2314 inside. One of the ends of a spring chamber has an "O"-ring seal 2315. The other end of a spring chamber connects with one of the manifold of the vacuum chamber. The spring spans along the longitudinal axis of the spring chamber. One end of the spring touches the back wall of the vacuum chamber. The other end of the spring is near the "O"-ring. The four wheels are mounted near the exterior corners of the bottom edges of the suction base. The wheels are so mounted that a small gap is kept between the bottom of the suction head and the carpet below.

The suction tube 2303 is a tube. One of its ends connects with the backside of the suction hood of the suction head. The other end of the suction tube has an enlarged portion 2316. This enlarged portion of the suction tube is inside a spring chamber of the suction base. The other end of the spring 2314 near the "O"-ring acts on the enlarged portion of the suction tube.

Figure 23:
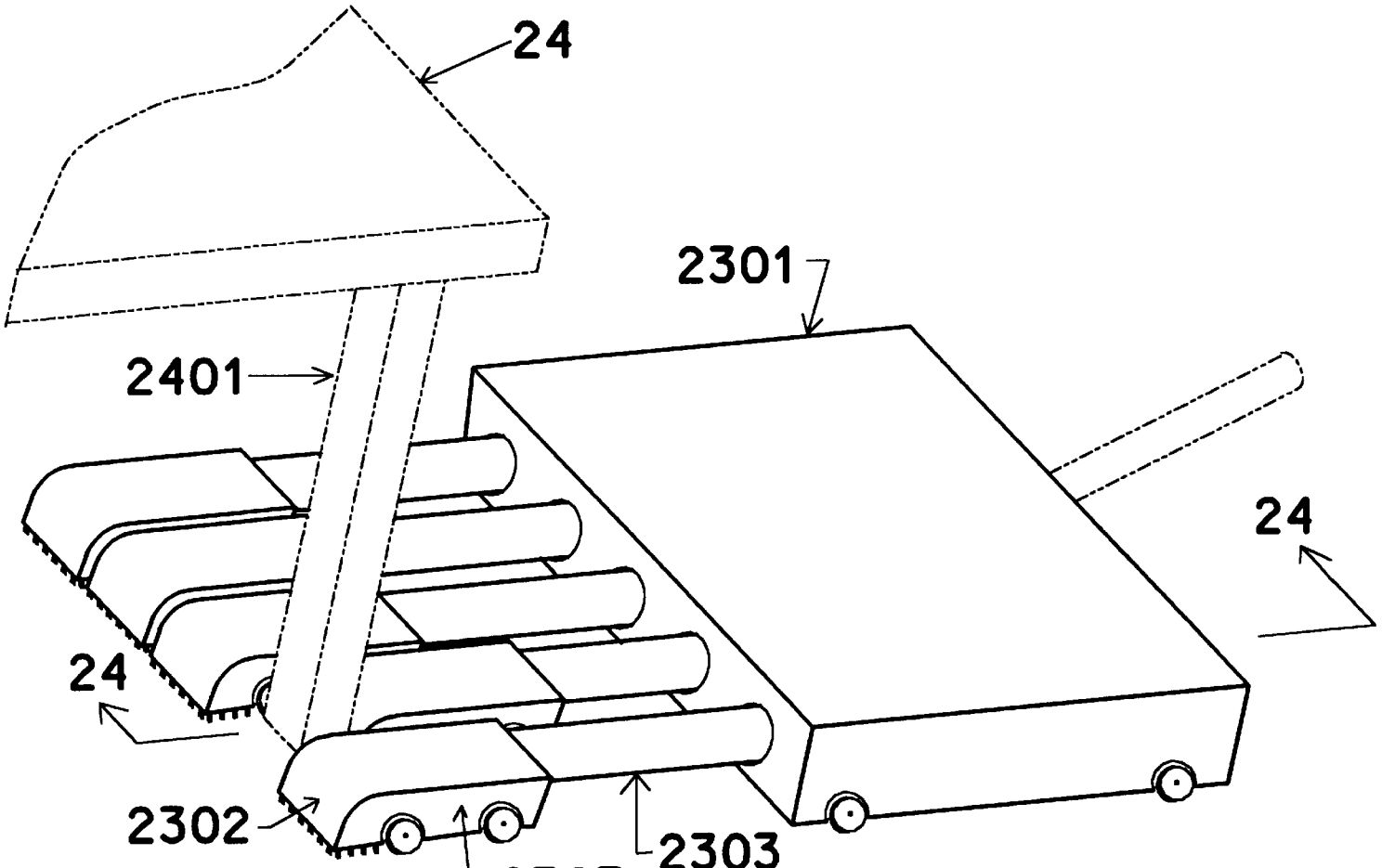
FIG. 23 is an isometric view which illustrates the operational functions of the invented device shown in FIG. 21.
Figure 24:
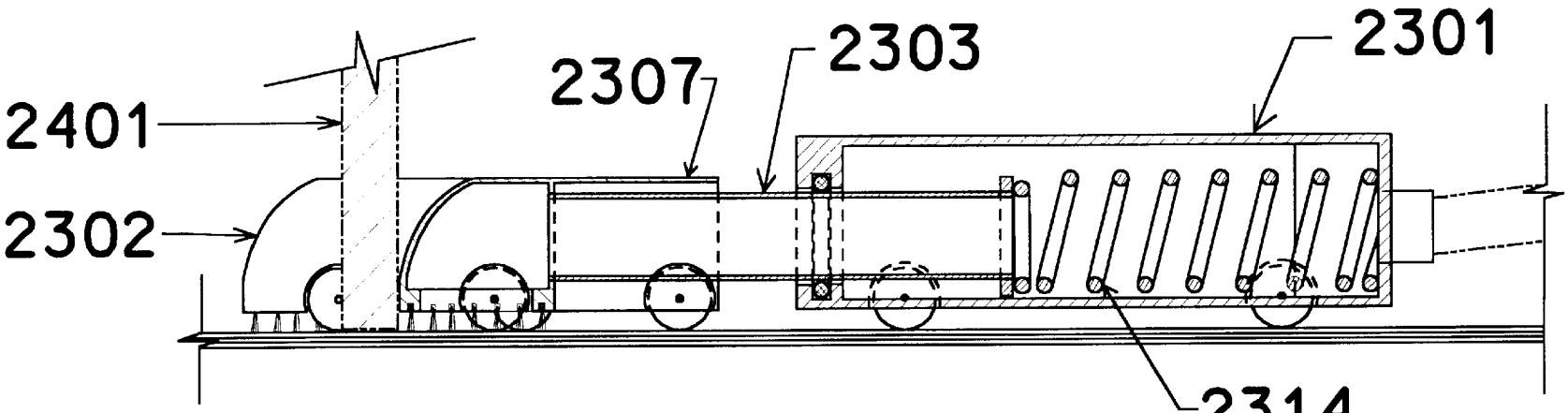
FIG. 24 is a sectional view which illustrates the operational functions of the invented device shown in FIG. 21.

Without meeting obstructions, the invented device works just as an ordinary vacuum head. When vacuuming a carpet floor, a user may pull backwards and push forwards the invented device by pulling and pushing the extension wand which is connected to a main body of a vacuum machine. Referring to FIGS. 23 and 24, when the invented device is being used and when it meets an obstacle 2401, such as a leg of a table 24, a number of the suction heads may be stopped by the obstacle while the rest suction heads may be pushed forward beyond the obstacle. Shown in FIG. 23, only one suction head is stopped by the obstacle. When a suction head is stopped by an obstacle while the rest suction heads are moving forwards, the spring 2314 of the suction head which associates with the stopped suction head is compressed and shortened. The elongated tube 2307 of the suction head will provide guide for the adjacent suction heads which are not stopped by the obstacles. The elongated tube will keep the back sides of the other suction heads from being tangled with the obstacle when the invented device is pulled back from the obstacle. When the invented device is pulled back from the obstacle, the spring 2314 will push the stopped suction head to its original position which will be on the same line of the rest suction heads.

Figure 25:
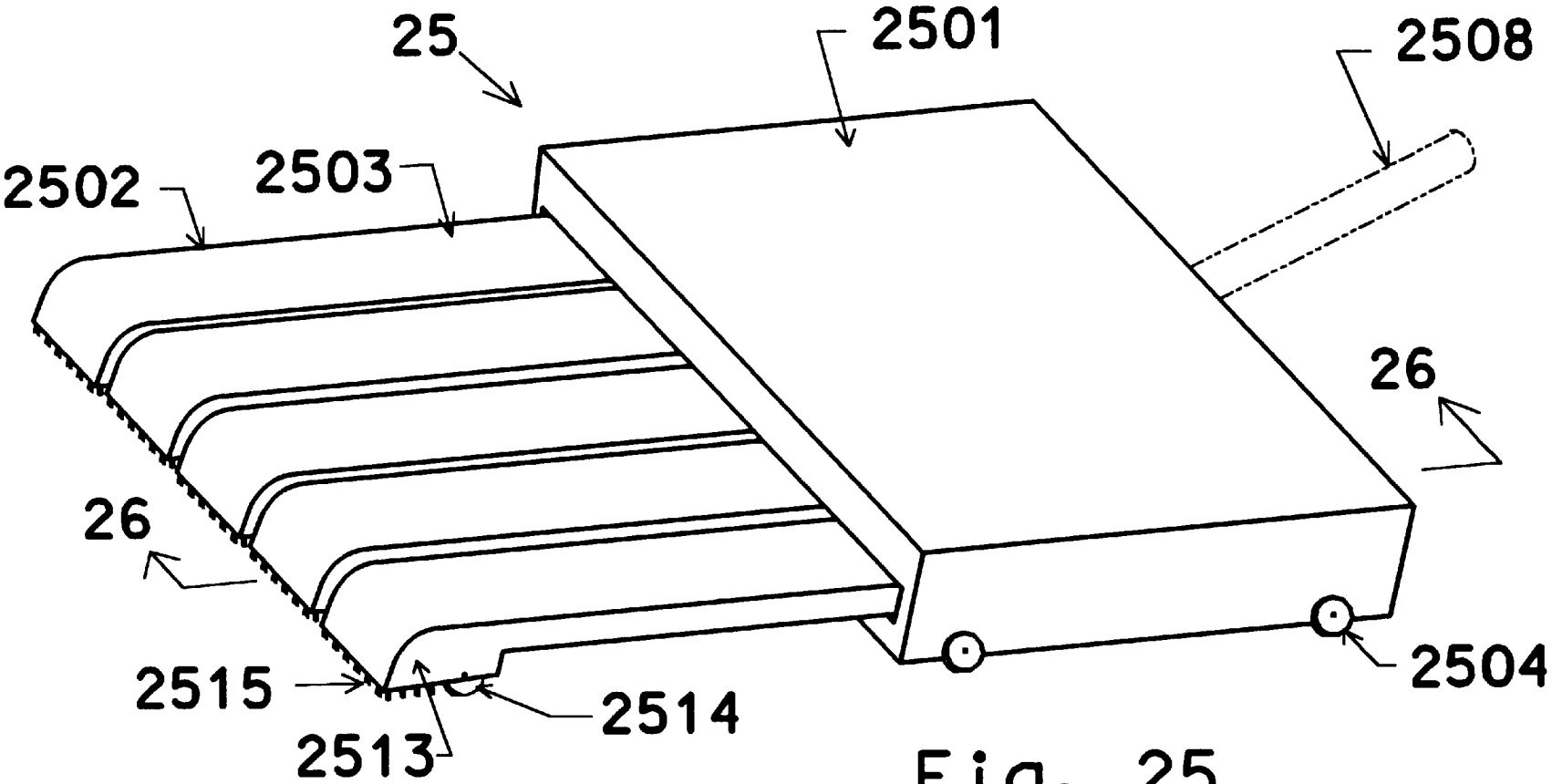
FIG. 25 is an isometric view of the second sub-variation of the fifth variation of the invented device.
Figure 26:
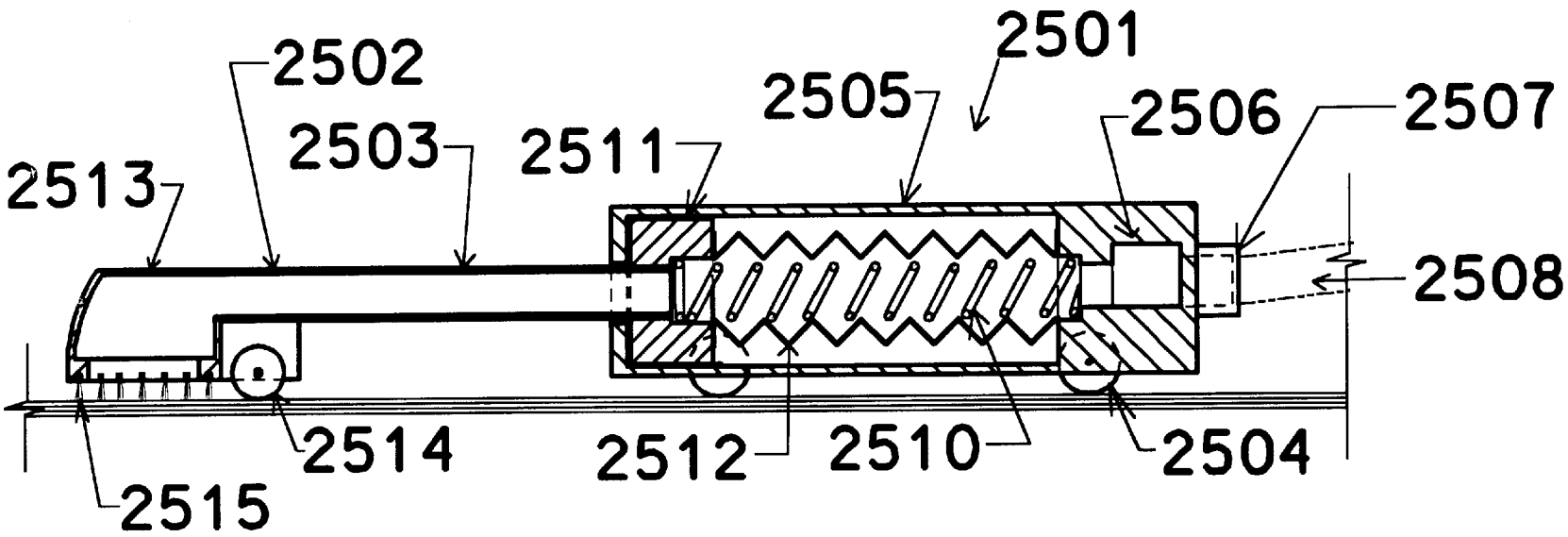
FIG. 26 is a sectional view of the device shown in FIG. 25.

A sub-variation of the fifth variations of the invented device is shown in FIGS. 25 and 26. Referring to FIGS. 25 and 26, this sub-variation of the fifth variation of the invented multiple suction nozzle head 25 consists of a suction base 2501, several suction heads 2502, and several suction tubes 2503.

The suction head 2502 consists of a suction hood 2513, two wheels 2514, and many dusting brushes 2515. The suction hood is basically is an upside down cup with a rectangular or similar cross-section in the front and two extruding walls in the back. The two wheels are mounted on the interior surfaces of these walls. The wheels are so mounted that a small gap is kept between the rim of the suction hood and the carpet below. The dusting brush are bristles that are mounted on the rim of the suction hood.

The suction base 2501 consists of four wheels 2504, many spring/bellow chambers 2505 and a vacuum chamber 2506. The vacuum chamber is a duct manifold with the spring/bellow chamber connecting on one sidewall and an extension wand connector 2507 on the opposite sidewall. The extension wand connector provides a device which can allow a conventional extension wand 2508 to be connected with the invented multiple suction nozzle vacuum head. A spring/bellow chamber is basically a duct with a spring 2510, a spring/bellow support 2511 and a bellow duct 2512 inside. The spring may be inside the bellow tube, or vice versa. An option that the spring is inside of the bellow tube is shown in FIG. 26. The spring/bellow support is a piston-like block with a hole in it. One end of the spring and one end of the bellow tube are connected with the spring/bellow support. The spring/bellow support can slide freely inside the spring/bellow chamber. The other end of the spring is connected with the wall of the vacuum chamber. The other end of the bellow duct is connected to the other wall of the vacuum chamber. The four wheels are mounted near the exterior corners of the bottom edges of the suction base. The wheels are so mounted that a small gap is kept between the bottom of the suction head and the carpet below.

The suction tube 2503 is a tube. One of its ends connects with the backside of the suction hood of the suction head. The other end of the suction tube connects to the hole of the spring/bellow support of the spring/bellow chamber.

The uses of this variation of the fifth variations of the invented devices are the same as those described for the other variation of the fifth variations of the invented devices. The bellow tube will provide seal and flexibility for this variation.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

I claim:

1. A multiple suction nozzle vacuum head assembly comprising, in combination:

a) a manifold supported by at least two wheels;

said manifold having means to connect with an extension wand of a vacuum cleaning machine;

b) at least two suction nozzles;

c) at least two ducts for conveying dust sucked by said at least two suction nozzles into said manifold;

d) said at least two suction nozzles being able to shift toward and away from said manifold;

e) at least two spring means, wherein each of said at least two spring means resiliently biases a corresponding suction nozzle at a preselected distance from the manifold; and, wherein each of said at least two spring means comprises a rod with at least one bearing and a spring; said rod penetrates through said spring and said at least one bearing along their longitudinal axes; said rod being able to slide on said at least one bearing; said at least one bearing being mounted on said manifold; said rod having an enlarged end and the other end of said rod being mounted on the corresponding suction nozzle.

2. The vacuum head assembly of claim 1 wherein each of said at least two spring means is configured to exert pressure in a direction relatively away from the manifold and toward the corresponding suction nozzle.

3. The vacuum head assembly of claim 2 wherein a portion of the spring in each of said at least two spring means is inside the corresponding suction nozzle.

4. The vacuum head assembly of claim 2 wherein the spring in each of said at least two spring means is located within said manifold.

5. The vacuum head assembly of claim 1 wherein the spring in each of said at least two spring means pushes against the corresponding suction nozzle and said manifold.

6. The vacuum head assembly of claim 1 wherein each of said at least two suction nozzles has a spring stopper which is connected to the rod of the corresponding spring means; and the spring in each of said at least two spring means pushes against the corresponding spring stopper and said manifold.

7. The vacuum head assembly of claim 1 wherein said manifold has a forwardly illuminating device and an electricity supply.

8. The vacuum head assembly of claim 1 wherein each of said at least two suction nozzles has a rim with bristles extending from said rim.

9. The vacuum head assembly of claim 1 wherein said at least two ducts have a support means mounted on said manifold.

10. The vacuum head assembly of claim 1 wherein one end of each of said at least two ducts connects with a corresponding suction nozzle and the other end of each of said at least two ducts connects with said manifold.

11. The vacuum head assembly of claim 1 wherein said at least two ducts comprise a flexible hose material.

12. The vacuum head assembly of claim 1 wherein said at least two ducts comprise a bellow type material.

13. The vacuum head assembly of claim 1 wherein said at least two ducts comprise a rigid type material.

14. The vacuum head assembly of claim 1 wherein said at least two ducts comprise a rigid type portion and a bellow type portion.

15. A multiple suction nozzle vacuum head assembly comprising in combination:

a) a manifold supported by at least two wheels;

said manifold having means to connect with an extension wand of a vacuum cleaning machine;

b) at least two suction nozzles;

c) at least two ducts for conveying dust sucked by said at least two suction nozzles into said manifold, each of said at least two ducts having a first end that connects to a respective suction nozzle and a second enlarged end located within said manifold;

d) said at least two suction nozzles being able to shift toward and away from said manifold;

e) at least two springs, wherein each of said at least two springs resiliently biases a corresponding suction nozzle at a pre-selected distance from said manifold, each of said at least two springs being located within said manifold and having one end that contacts an endwall of said manifold and another end that contacts the second enlarged end of the duct that connects with said corresponding suction nozzle;

f) each of said at least two suction nozzles having at least one wheel.

16. A multiple suction nozzle vacuum head assembly comprising in combination:

a) a manifold supported by at least two wheels;

said manifold having means to connect with an extension wand of a vacuum cleaning machine;

b) at least two suction nozzles;

c) at least two ducts for conveying dust sucked by said at least two suction nozzles into said manifold;

d) said at least two suction nozzles being supported to shift toward and away from said manifold;

e) a spring means to resiliently and independently bias each of said at least two suction nozzles at a pre-selected distance from said manifold;

wherein said at least two ducts are supported by a rack with upwardly extended brackets and said rack is mounted on said manifold.

17. A multiple suction nozzle vacuum head assembly comprising in combination:

a) a manifold supported by at least two wheels;

said manifold having means to connect with an extension wand of a vacuum cleaning machine;

b) at least two suction nozzles;

c) at least two ducts for conveying dust sucked by said at least two suction nozzles into said manifold;

d) said at least two suction nozzles being able to shift toward and away from said manifold;

e) at least two spring means, wherein each of said at least two spring means resiliently biases a corresponding suction nozzle at a pre-selected distance from said manifold;

f) each of said at least two suction nozzles having a bearing, a dusting brush and a suction head position rod; said bearing being mounted on a wall of the corresponding suction nozzle; said dusting brush consisting of bristles mounted on a tube; said suction head position rod penetrating through said bearing and said tube of said dusting brush; said suction head position rod being able to rotate in said bearing but being unable to rotate in said tube; the suction head position rod in each of said at least two suction nozzles being mounted in a bearing on said manifold;

g) at least one dusting brush rocking means mounted on at least one suction head position rod which rocks said at least one suction head position rod and the corresponding dusting brush associated with said at least one suction head position rod;

h) an electrical motor and its corresponding electrical supply being mounted on said manifold;

i) a torque transmission means for transmitting torque generated by said electrical motor to a rocking transmission means which rocks said at least one dusting brush rocking means.

18. The vacuum head assembly of claim 17 wherein said torque transmission means comprises a pulley mounted on said electrical motor, a pulley mounted on said rocking transmission means, and at least one belt connecting said pulleys.

19. The vacuum head assembly of claim 17 wherein said rocking transmission means comprises a brush power transmission rod that rotates on its longitudinal axis, at least one transmission rod bearing that supports said brush power transmission rod, and at least one pair of cams mounted on said brush power transmission rod; said at least one transmission rod bearing being mounted on said manifold; said cams in at least one pair of cams having an approximately 180 degree phase shift with respect to each other; said at least one dusting brush rocking means comprising a rocking rod with a wheel on each end and a mount at its center for mounting to said at least one suction head position rod; wherein each of said cams in said at least one pair of cams is aligned with and engages a corresponding wheel on said rocking rod so as to cause a rocking motion of said at least one dusting brush rocking means when said power transmission rod rotates on its longitudinal axis.

20. The vacuum head assembly of claim 17 wherein said rocking transmission means comprises a brush power transmission rod that rotates on its longitudinal axis, at least one transmission rod bearing that supports said brush power transmission rod, and at least one cam mounted on said brush power transmission rod; said at least one transmission rod bearing being mounted on said manifold; said at least one dusting brush rocking means comprising a rocking rod with a mounting hole near one end and a penetrating hole in the middle, a spring, and a wheel on the other end; one end of said spring being mounted to the rocking rod at said penetrating hole; the other end of said spring being mounted on a wall extending from said manifold; wherein said at least one suction head position rod penetrates through said mounting hole of said rocking rod, and said at least one cam is aligned with and engages said wheel on said rocking rod so as to cause rocking motion of said at least one dusting brush rocking means when said power transmission rod rotates on its longitudinal axis.

21. The vacuum head assembly of claim 17 wherein said rocking transmission means comprises a brush power transmission rod that rotates on its longitudinal axis, at least one transmission rod bearing that supports said brush power transmission rod, and at least one cam mounted on said brush power transmission rod; said at least one transmission rod bearing being mounted on said manifold; said at least one dusting brush rocking means comprising a rocking rod with a counter weight near one end, a mounting hole in the middle, and a wheel on the other end; wherein said at least one suction head position rod penetrates through said mounting hole of said rocking rod, and said cam is aligned with and engages said wheel on said rocking rod so as to cause rocking motion of said dusting brush rocking means when said power transmission rod rotates on its longitudinal axis.

22. The vacuum head assembly of claim 17 wherein said torque transmission means comprises a gear train mounted between said electrical motor and said rocking transmission means.

* * * * *